US008950602B2

(12) United States Patent
Fanourgiakis et al.

(10) Patent No.: US 8,950,602 B2
(45) Date of Patent: Feb. 10, 2015

(54) VARIABLE PLANFORM SHELVING SYSTEM

(75) Inventors: George Fanourgiakis, Foster City, CA (US); Lawrence J. Brucia, San Anselmo, CA (US)

(73) Assignee: Techni, LLC, Burlingame, CA (US)

( * ) Notice: Subject to any disclaimer, the term of this patent is extended or adjusted under 35 U.S.C. 154(b) by 346 days.

(21) Appl. No.: 13/359,016

(22) Filed: Jan. 26, 2012

(65) Prior Publication Data

US 2013/0193098 A1 Aug. 1, 2013

(51) Int. Cl.
*A47F 5/00* (2006.01)
*A47B 11/00* (2006.01)

(52) U.S. Cl.
USPC ..... 211/175; 108/102

(58) Field of Classification Search
CPC ..... A47B 45/00; A47B 46/00; A47B 96/021; A47B 5/0068; A47B 96/025
USPC ..... 211/134, 90.02, 126.6, 144, 186, 150, 211/149, 169, 189, 175, 187, 59.2; 108/180, 181, 185, 186, 102, 147.12, 108/137; 312/265.6, 265.5, 278
See application file for complete search history.

(56) References Cited

U.S. PATENT DOCUMENTS

| | | | | | |
|---|---|---|---|---|---|
| 440,554 | A | * | 11/1890 | Fisher | 108/99 |
| 2,694,611 | A | | 11/1954 | Lorber | |
| 2,705,179 | A | | 3/1955 | Hodgin | |
| 2,888,305 | A | * | 5/1959 | Perry | 108/65 |
| 3,002,787 | A | | 10/1961 | Ziegenfuss | |
| 3,538,862 | A | | 11/1970 | Patriarca | |
| 4,223,613 | A | * | 9/1980 | Yoshizawa | 108/64 |
| 4,500,146 | A | | 2/1985 | Peterson | |
| 4,501,369 | A | * | 2/1985 | Fox | 211/133.1 |
| 4,553,523 | A | * | 11/1985 | Stohrer, Jr. | 126/9 B |
| 5,415,302 | A | | 5/1995 | Carlson et al. | |
| 5,568,775 | A | * | 10/1996 | Rizzi et al. | 108/64 |
| 5,943,966 | A | * | 8/1999 | Machado et al. | 108/64 |
| 5,967,058 | A | | 10/1999 | Ambrose et al. | |
| 6,079,803 | A | * | 6/2000 | West et al. | 312/107 |
| 6,206,495 | B1 | | 3/2001 | Peterson | |
| 6,364,137 | B1 | * | 4/2002 | Glauth et al. | 211/186 |
| 6,375,285 | B1 | | 4/2002 | Choi | |

(Continued)

FOREIGN PATENT DOCUMENTS

| | | |
|---|---|---|
| CA | 2701266 | 10/2011 |
| DE | 29302313 | 5/1998 |

(Continued)

OTHER PUBLICATIONS

PCT/US2013/023449, International Patent Application, filed Jan. 28, 2013, Titled Variable Planform Shelving System.

(Continued)

*Primary Examiner* — Patrick Hawn
(74) *Attorney, Agent, or Firm* — Kilpatrick Townsend & Stockton, LLP

(57) ABSTRACT

Variable planform shelving systems include a variable support platform and a support surface assembly that is supported by the variable support platform. The variable support platform includes frames that can be repositioned relative to each other to vary the planform of the variable support platform. The support surface assembly provides a support surface for supported items. The support surface assembly is flexible and/or comprised of a plurality of linked panels so that the support surface provided varies in response to variation in the planform of the variable support platform.

2 Claims, 26 Drawing Sheets

(56) References Cited

U.S. PATENT DOCUMENTS

| | | | | |
|---|---|---|---|---|
| 7,182,210 | B2 * | 2/2007 | Metcalf | 211/175 |
| 7,246,711 | B1 | 7/2007 | Metcalf | |
| 7,509,913 | B1 * | 3/2009 | Eagle | 108/90 |
| 7,857,329 | B2 * | 12/2010 | Cai | 280/47.35 |
| 8,376,156 | B2 * | 2/2013 | Jarvis et al. | 211/187 |
| 2004/0164655 | A1 | 8/2004 | Wood et al. | |
| 2004/0245200 | A1 | 12/2004 | Jersey et al. | |
| 2006/0016774 | A1 * | 1/2006 | Bustos | 211/186 |
| 2007/0095768 | A1 * | 5/2007 | Huo | 211/113 |
| 2010/0193456 | A1 | 8/2010 | Polizzi et al. | |
| 2012/0000867 | A1 * | 1/2012 | Saving | 211/59.2 |

FOREIGN PATENT DOCUMENTS

| | | |
|---|---|---|
| EP | 539957 | 5/1993 |
| WO | 2011161682 | 12/2011 |

OTHER PUBLICATIONS

PCT/US2015/023449, "Invitation to Pay Additional Fees and Partial Search Report", mailed Apr. 2, 2013, 5 pages.

PCT/US2013/023449, "International Search Report and Written Opinion", mailed Jul. 15, 2015, 16 pages.

* cited by examiner

FIG. 20
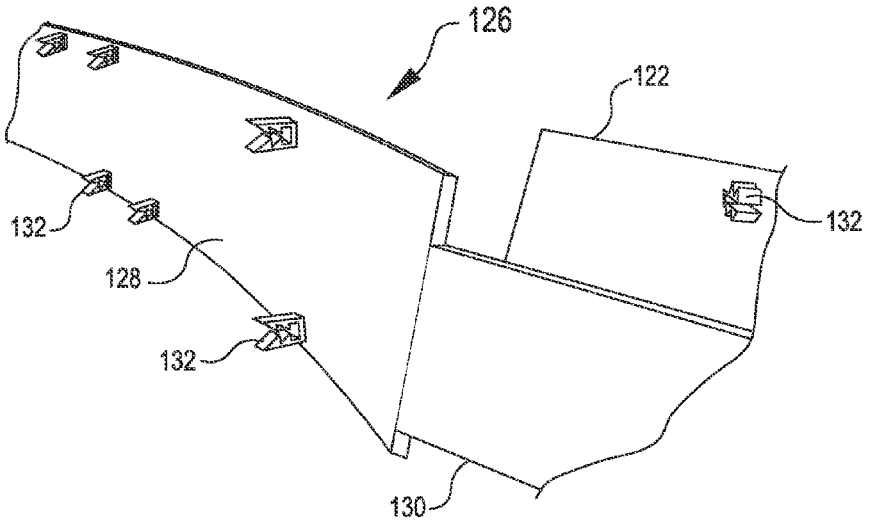
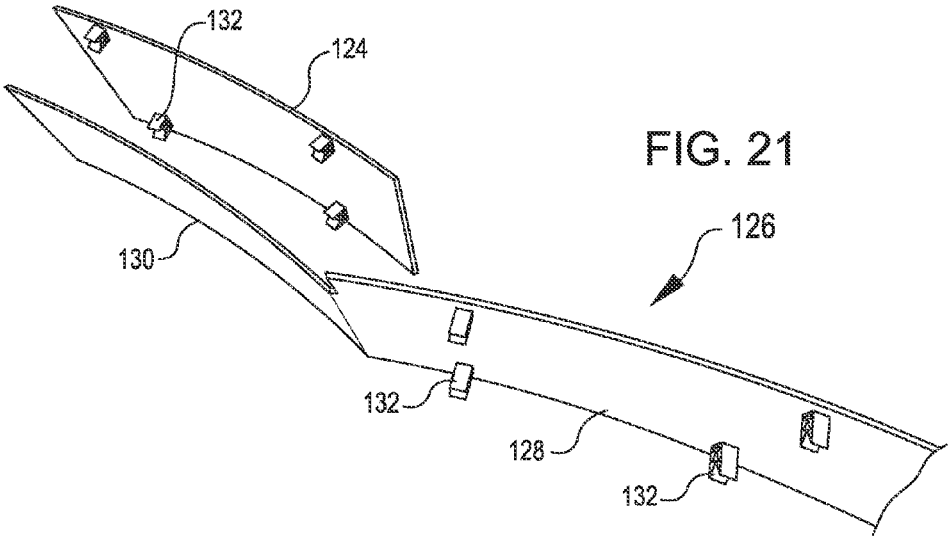
FIG. 21
FIG. 22
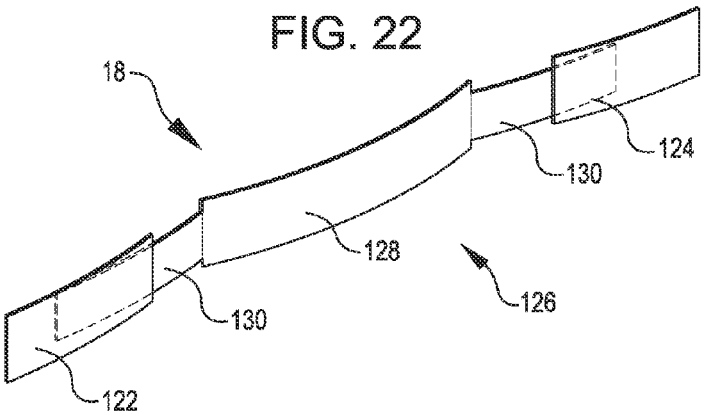

VARIABLE PLANFORM SHELVING SYSTEM

BACKGROUND

Shelves are often used for displaying and/or storing items. For example, a retail outlet, such as a grocery store, typically includes multiple rows of shelves separated by aisles. The rows of shelves typically include shelves having differing configurations suitable for the different types of merchandise being displayed and/or stored.

Many existing shelving systems can be customized to some extent for the display and/or storage of particular items. For example, the number of shelves used and/or the vertical spacing between shelves can often be varied. And the size of the shelves used can be selected in advance based on the space available for the shelf. Existing shelving systems, however, may be insufficiently reconfigurable to avoid having to be replaced with new shelves of a different configuration as part of a reconfiguration of a retail outlet or remodeling of a residence.

Accordingly, there is believed to be a need for shelving systems and related items that can be reconfigured to a greater extent than existing shelving systems.

BRIEF SUMMARY

Shelves, shelving systems, and related items (e.g., tables, clothes racks) having a variable planform are disclosed. The assemblies disclosed herein include a variable support platform, which can be resized and/or reshaped, and a support surface assembly that is supported by the variable support platform. The support surface assembly provides a support surface that is resized and/or reshaped in response to resizing and/or reshaping of the variable support platform. Accordingly, the shelving assemblies and related items disclosed herein have increase flexibility to be reconfigured into desired shapes and/or sizes relative to existing shelving assemblies.

Thus, in one aspect, a shelf is provided that has a variable planform. The shelf includes a first frame providing a first part of a variable support platform, a second frame providing a second part of the variable support platform, and a support surface assembly that is supported by the variable support platform and provides a support surface for items supported by the shelf. Relative positioning between the first and second frames is variable so as to vary the planform of the variable support platform. The support surface assembly is flexible and/or includes a plurality of linked panels so that the support surface provided varies in response to variation in the planform of the variable support platform. In many embodiments, relative orientation of the first and second frames is variable to vary the shape of the planform of the variable support platform.

In many embodiments, the shelf further includes a third frame providing a third part of the variable support platform. The third frame is disposed between the first and second frames. Relative positioning between the third frame and each of the first and second frames is variable to vary the planform of the variable support platform. For example, the third frame can be slidingly coupled with each of the first and second frames.

In many embodiments, relative orientation between the first and third frames is variable to vary the shape of the planform of the variable support platform. And in many embodiments, relative orientation between the second and third frames is variable to vary the shape of the planform of the variable support platform.

The first, second, and third frames can have suitable details that contribute to providing the variable support platform. For example, the first frame and/or the second frame can have a slot that receives a portion of the third frame. In many embodiments, each of the first, second, and third frames has an upper surface that interfaces with the support surface assembly with the upper surfaces being coplanar. In many embodiments, the first frame and/or the second frame has a planform shape of half of an ellipse and the third frame has a planform shape of an ellipse.

In many embodiments, the third frame includes an elongated aperture. The elongated aperture receives a first coupling pin coupled with the first frame and extending across the first frame slot. The elongated aperture further receives a second coupling pin coupled with the second frame and extending across the second frame slot. In many embodiments, each of the first frame and the second frame includes an end portion adapted to attach to a support at one end of the end portion.

In many embodiments, the shelf support surface assembly is configured such that the planform of the support surface assembly varies in response to variation in the planform of the variable support platform. For example, in many embodiments, the shelf support surface assembly includes a plurality of interconnected vertically-oriented flexible panels. The flexible panels are formed from a suitable material (e.g., polycarbonate). And in many embodiments, the shelf support surface assembly includes a plurality of coupled horizontally-oriented panels. For example, each of the horizontally-oriented panels can have one or more slots receiving connecting pins that couple adjacent panels of the horizontally-oriented panels.

In another aspect, a shelving system having a variable planform is provided. The shelving system includes a first shelf having a variable planform, a second shelf having a variable planform and being elevated above the first shelf, at least one first support column, and at least one second support column. In many embodiments, each of the first and second shelves include first, second, and third frames as described herein. The first support column(s) supports the first frames of the first and second shelves. And the second support column(s) supports the second frames of the first and second shelves. In many embodiments, one or more supplemental support columns are used.

In many embodiments, the shelving system includes a base. The base can include an upper portion that includes a shelf having a variable planform as describe herein, a lower portion that includes a shelf having a variable planform as described herein, at least one first column member attached to each of the first frames of the upper and lower portions, at least one second column member attached to each of the second frames of the upper and lower portions, and a plurality of third column members, each of the column members being attached to the third frames of the upper and lower portions.

In many embodiments, the shelving system includes a kick plate assembly attached to the base. The kick plate assembly can include a first kick plate member attached to at least one of the first frames of the upper and lower portions, a second kick plate member attached to at least one of the second frames of the upper and lower portions, and a third kick plate member attached to at least one of the third frames of the upper and lower portions. At least one of the first, second, or third kick plate members can include an extension panel overlapping an adjacent one of the first, second, or third kick plate members for a plurality of planform configurations of the base.

In many embodiments, the shelving system includes at least one price display assembly attached to at least one of the first and second shelves. The price display assembly can include a first price display segment attached to the first frame and configured to display a price tag, a second price display segment attached to the second frame and configured to display a price tag, and a third price display segment slidably coupled with at least one of the first and second price display segments. The third price display segment is flexible and configured to display a price tag.

In another aspect, a table having a variable planform is provided. The table includes a first upper frame forming a first part of a variable support platform, a second upper frame forming a second part of the variable support platform, a third upper frame providing a third part of the variable support platform, a support surface assembly providing a support surface for items supported by the table, a first base frame forming part of a variable base that is disposed below the variable support platform, a second base frame forming part of the variable base, a third base frame forming part of the variable base, and a plurality of intermediate members disposed between and attached to the variable base and the variable support platform. The third upper frame is disposed between the first and second upper frames. Relative positioning and orientation between the third upper frame and each of the first and second upper frames is variable so as to vary the planform of the variable support platform. The support surface assembly is supported by the variable support platform. The support surface assembly can be at least one of flexible or include a plurality of linked panels so that the support surface provided varies in response to variation in the planform of the variable support platform. The third base frame is disposed between the first and second base frames. Relative positioning and orientation between the third base frame and each of the first and second base frames is variable to vary the planform of the variable base.

In many embodiments, the intermediate members include a plurality of first intermediate members, a plurality of second intermediate members, and a plurality of third intermediate members. Each of the first intermediate members is attached to the first upper frame and the first base frame. Each of the second intermediate members is attached to the second upper frame and the second base frame. And each of the third intermediate members is attached to the third upper frame and the third base frame. Any suitable configuration of intermediate member can be used, for example, a column member.

In many embodiments, the table support surface assembly is configured such that the planform of the support surface assembly varies in response to variation in the planform of the variable support platform. For example, in many embodiments, the table support surface assembly includes a plurality of interconnected vertically-oriented flexible panels. As another example, in many embodiments, the table support surface assembly includes a plurality of coupled horizontally-oriented panels having one or more slots receiving coupling pins that couple adjacent panels of the horizontally-oriented panels.

For a fuller understanding of the nature and advantages of the present invention, reference should be made to the ensuing detailed description and accompanying drawings. Other aspects, objects and advantages of the invention will be apparent from the drawings and detailed description that follows.

BRIEF DESCRIPTION OF THE DRAWINGS

FIG. 20 and FIG. 21 are perspective views of components of the kick plate assembly of FIG. 17.

FIG. 22 is a perspective view of the kick plate assembly of FIG. 17 in an expanded configuration.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
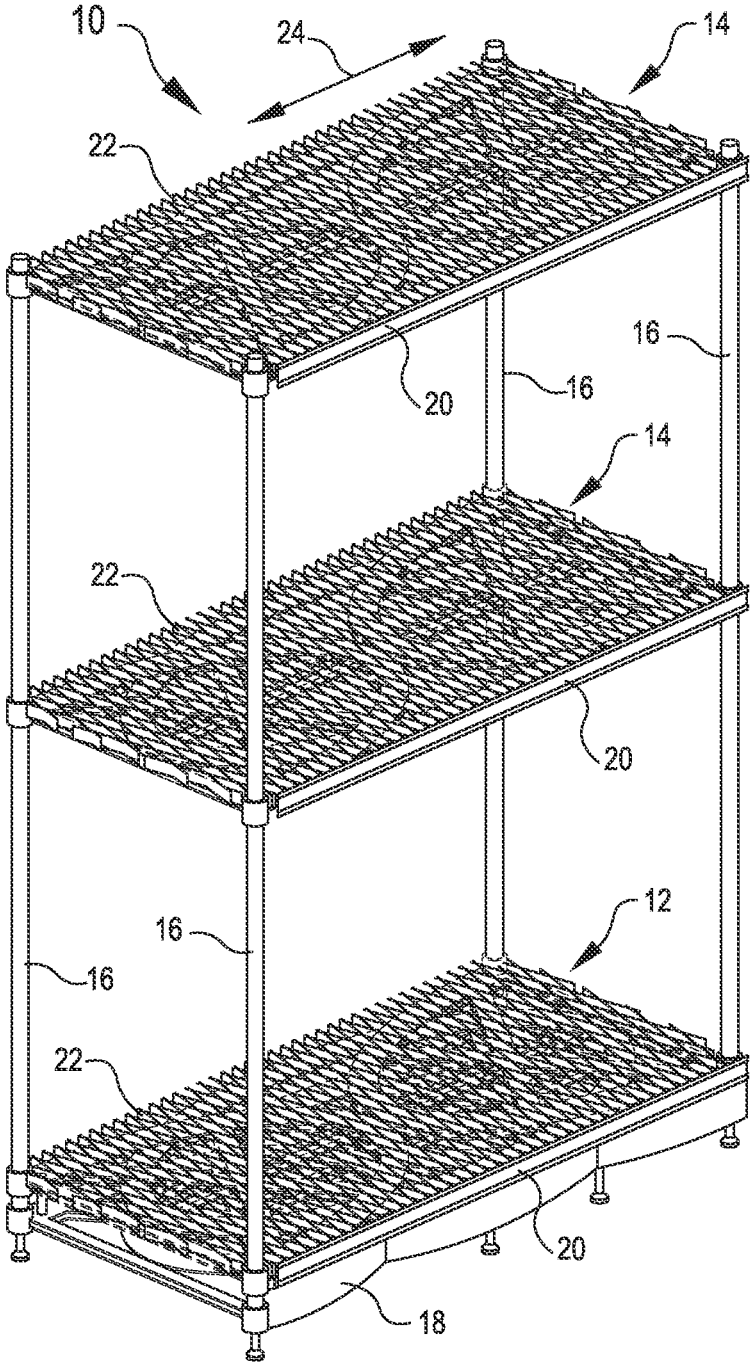
FIG. 1 is a perspective view of a variable-planform shelving system in a compact collapsed configuration, in accordance with many embodiments.

Referring now to the drawings, in which like reference numerals represent like parts throughout the several views, FIG. 1 shows a variable-planform shelving system 10, in accordance with many embodiments. The shelving system 10 is shown in a compact collapsed configuration. The shelving system 10 includes a variable-planform base 12, variable planform shelves 14, four support posts 16, a kick plate assembly 18, and price display assemblies 20. Although two variable planform shelves 14 are shown, the variable-planform shelving system 10 can include any suitable number of variable planform shelves 14 (e.g., 1 or more).

The variable-planform base 12 and each of the variable planform shelves 14 include a support surface assembly 22 that provides a support surface for items supported by the shelving system 10. In the embodiment shown, the support surface assemblies 22 are fabricated from a plurality of vertically-oriented panels that are intermittently bonded together such that a support surface assembly 22 can be expanded in a lengthwise direction 24 (perpendicular to the orientation of the vertically-oriented panels) without any substantial contraction perpendicular to the lengthwise direction 24. In addition to being expandable in the lengthwise direction 24, the support surface assembly 22 is flexible to conform to a variety of curved planforms in which the shelving system 10 can be configured.

Figure 2:
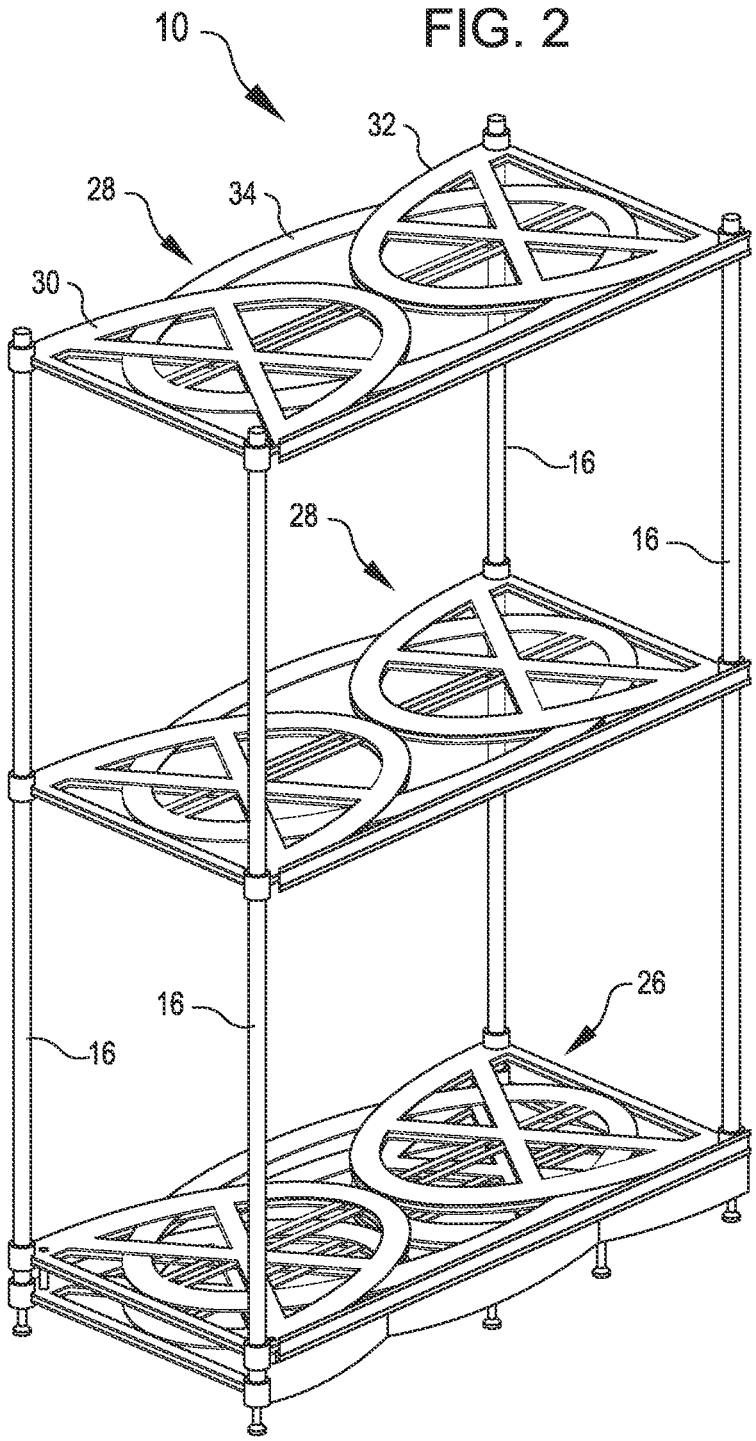
FIG. 2 is a perspective view of the variable-planform shelving system of FIG. 1 with support surface assemblies removed to show details of underlying shelf variable support platforms and a variable base.

FIG. 2 shows the shelving system 10 in the compact collapsed configuration with the support surface assemblies 22 removed to better show details of a base support platform 26 portion of the variable-planform base 12 and a variable support platform 28 portion of the shelves 14. The base support platform 26 supports a support surface assembly 22. Likewise, each of the variable support platforms 28 support a support surface assembly 22. The base support platform 26 and the variable support platforms 28 are supported by the four support posts 16.

The base support platform 26 and the variable support platforms 28 are reconfigurable into any of a continuous range of different planforms including expanded planforms, a variety of curved planforms, and combinations thereof. Each variable support platform 28 includes a first frame 30, a second frame 32, and a third frame 34. The third frame 34 has an elliptical outer perimeter. Each of the first and second frames 30, 32 have an outer perimeter shape of a half ellipse. A first portion of the third frame 34 is slidably received within a horizontally-oriented slot in the first frame 30 and a second portion of the third frame 34 is slidably received within a horizontally-oriented slot in the second frame 32. The planform of the variable support platform 28 is selectively varied by repositioning and/or reorienting the third frame 34 relative to the first frame 30 and/or relative to the second frame 32.

Figure 3:
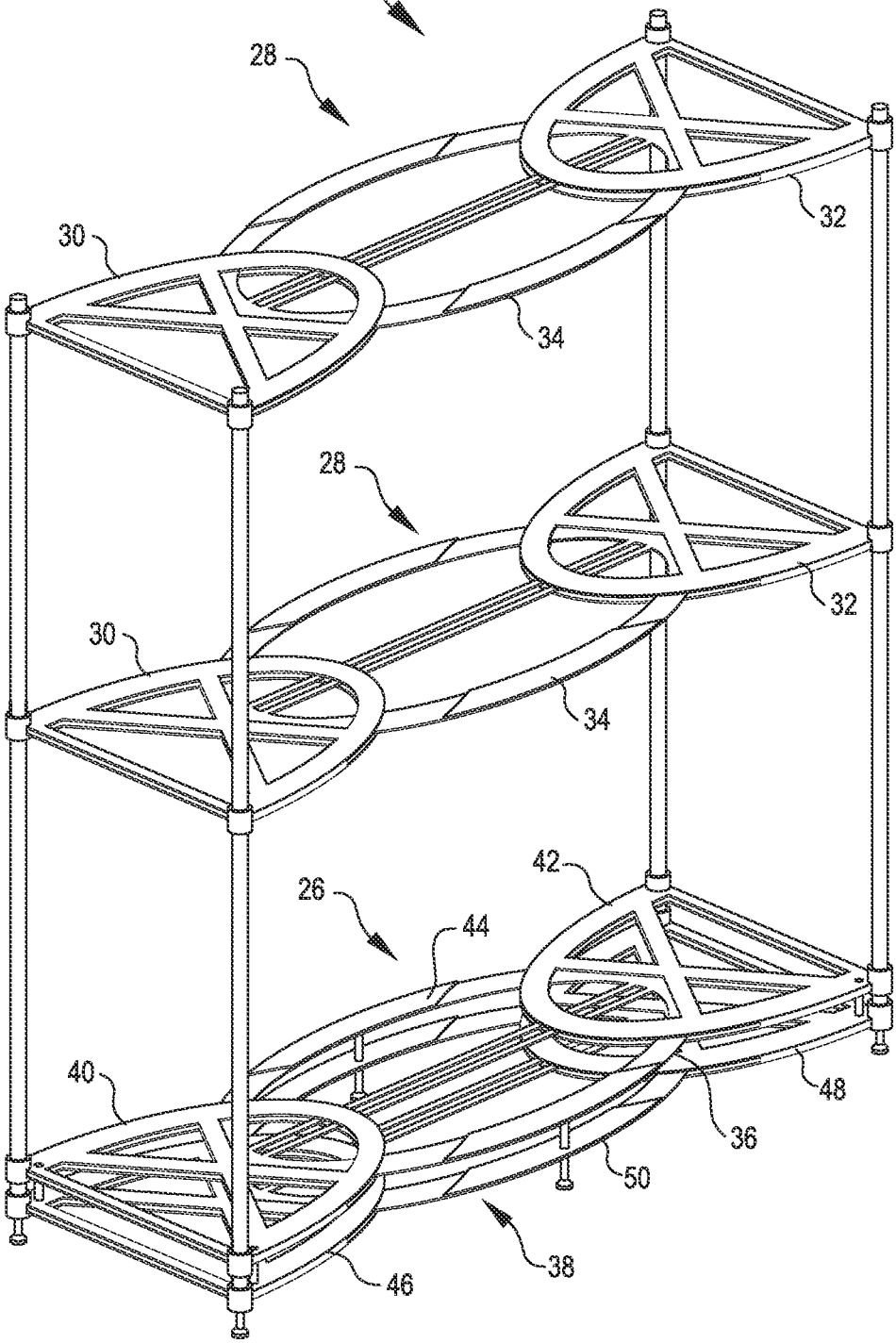
FIG. 3 is a perspective view of the variable-planform shelving system of FIG. 1 in a partially-expanded configuration with the support surface assemblies removed to show details of the underlying shelf variable support platforms and the variable base.

In a similar fashion, the planform of the base support platform 26 can be selectively varied. The planform of the base support platform 26 and the planform of each of the variable support platforms 28 can be varied in the same way so that each of the support posts 16 remains vertical. For example, FIG. 3 shows the shelving system 10 in a partially expanded configuration with the support surface assemblies 22 removed to better show the partially expanded states of the base support platform 26 and the variable support platforms 28.

The base support platform 26 includes an upper portion 36 and a lower portion 38. The upper portion 36 includes a first upper frame 40, a second upper frame 42, and a third upper frame 44 that are configured similar to the first, second, and third frames 30, 32, 34 of the variable support platforms 28. The third upper frame 44 has an elliptical outer perimeter. Each of the first and second upper frames 40, 42 has an outer perimeter in the shape of a half ellipse. A first portion of the third upper frame 44 is slidably received within a horizontally-oriented slot in the first upper frame 40 and a second portion of the third upper frame 44 is slidably received within a horizontally-oriented slot in the second upper frame 42. Likewise, the lower portion 38 includes a first lower frame 46, a second lower frame 48, and a third lower frame 50 that are configured similar to the first, second, and third frames 30, 32, 34 of the variable support platforms 28. The third lower frame 50 has an elliptical outer perimeter. Each of the first and second lower frames 46, 48 has an outer perimeter in the shape of a half ellipse. A first portion of the third lower frame 50 is slidably received within a horizontally-oriented slot in the first lower frame 46 and a second portion of the third upper frame 50 is slidably received within a horizontally-oriented slot in the second lower frame 48. The planform of the base support platform 26 is selectively varied by repositioning and/or reorienting the third upper and third lower frames 44, 50 relative to the first upper and first lower frames 40, 46 and/or relative to the second upper and second lower frames 42, 48.

Figure 4:
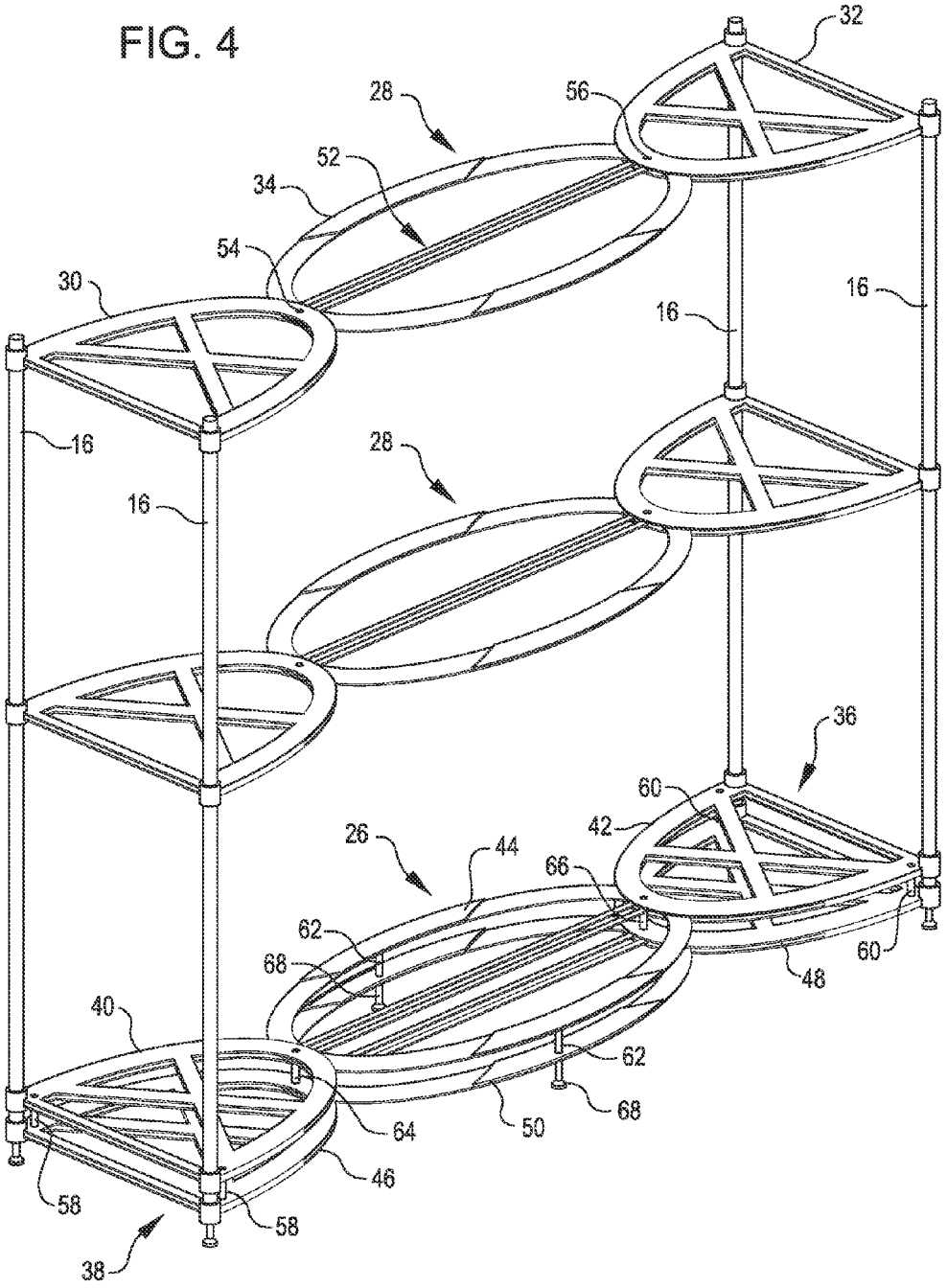
FIG. 4 is a perspective view of the variable-planform shelving system of FIG. 1 in a fully-expanded configuration with the support surface assemblies removed to show details of the underlying shelf variable support platforms and the variable base.

Additional details of the shelving system 10 will now be described with reference to FIG. 4, which shows the shelving system 10 in a fully expanded in-line configuration. As shown, the third frame 34 of the variable support platforms 28 has a elongated aperture 52 that extends from one end of the third frame 34 to the other. The elongated aperture 52 receives a first coupling pin 54 that is coupled with the first frame 30 and extends across the first frame slot, thereby extending through the elongated aperture 52. The elongated aperture 52 further receives a second coupling pin 56 that is coupled with the second frame 32 and extends across the second frame slot, thereby extending through the elongated aperture 52. In the fully expanded in-line configuration, the coupling pins 54, 56 are disposed at opposing ends of the elongated aperture 52, thereby retaining the ends of the third frame 34 within the first and second frame slots. Additionally, the coupling pins 54, 56 can be configured to clamp the first and second frames 30, 32 onto the third frame, thereby preventing inadvertent reconfiguration of the variable support platform 28 and enhancing the transfer of bending moments from the third frame 34 to the first and second frames 30, 32. In many embodiments, suitable threaded fasteners are used as the coupling pins 54, 56.

The upper and lower portions 36, 38 of the base support platform 26 are connected by intermediate members (e.g., a column members). Adjacent to the support posts 16, the first upper and first lower frames 40, 46 are connected by two column members 58. Likewise, adjacent to the other support posts 16, the second upper and second lower frames 42, 48 are connected by two column members 60. The third upper and third lower frames 44, 50 are connected by two column members 62 disposed midway along opposing sides of the third upper and third lower frames 44, 50. A column member 64 connects the first upper and first lower frames 40, 46. The column member 64 can also be configured to clamp the first upper and first lower frames 40, 46 onto the third upper and third lower frames 44, 50, respectively, thereby preventing inadvertent reconfiguration of the base support platform 26 and enhancing the transfer of bending moments from the third upper and third lower frames 44, 50 to the first upper and first lower frames 40, 46. For example, a suitable threaded fastener can be used in conjunction with the column member 64 to provide the clamping force. A column member 66 connects the second upper and second lower frames 42, 48. The column member 66 can also be configured to clamp the second upper and second lower frames 42, 48 onto the third upper and third lower frames 44, 50, respectively, thereby preventing inadvertent reconfiguration of the base support platform 26 and enhancing the transfer of bending moments from the third upper and third lower frames 44, 50 to the second upper and second lower frames 42, 48. For example, a suitable threaded fastener can be used in conjunction with the column member 66 to provide the clamping force. A height adjustable support 68 is disposed directly below each of the column members 62 and helps to stabilize the base support platform 26.

Figure 5:
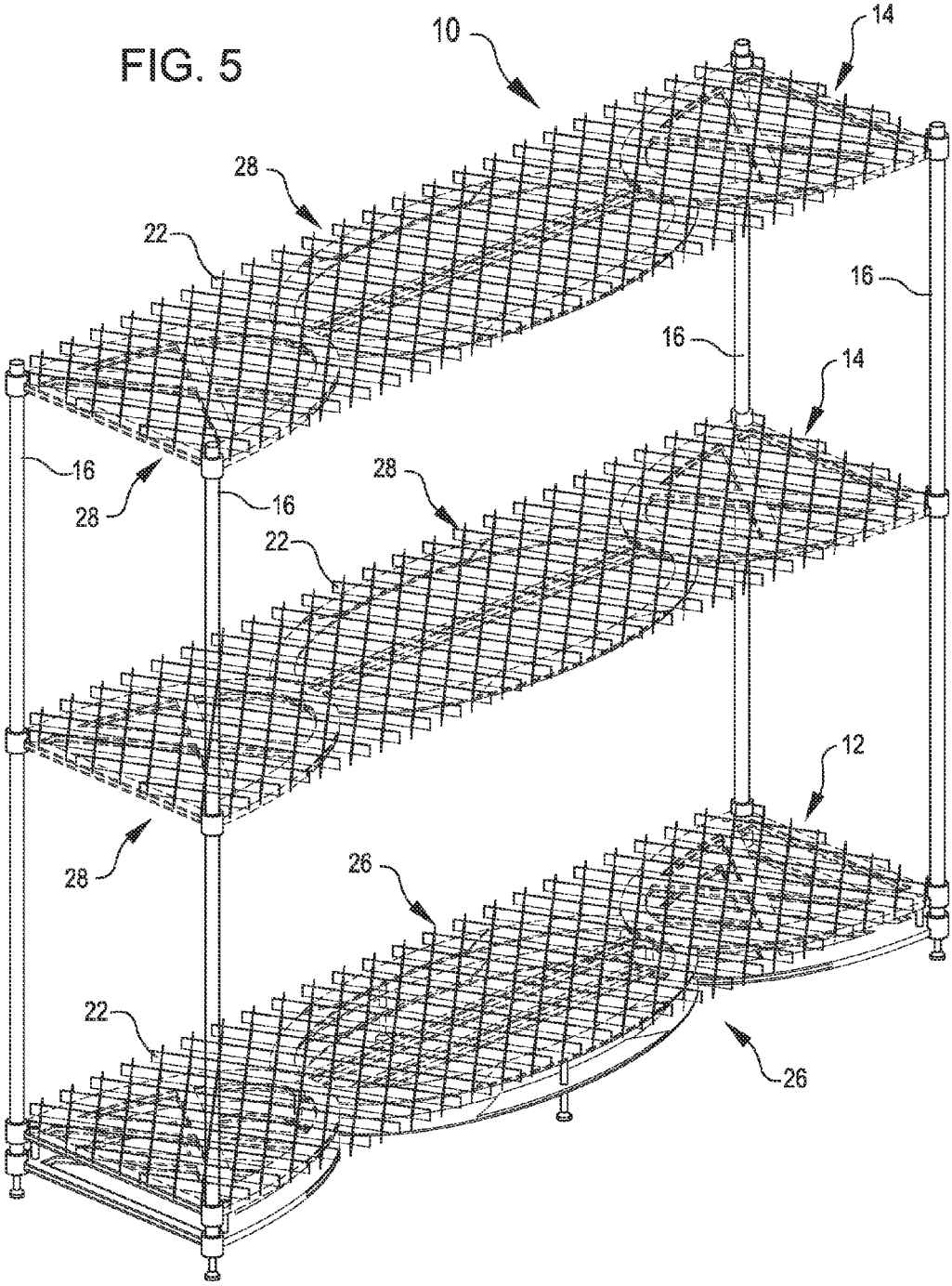
FIG. 5 is perspective view of the variable-planform shelving system of FIG. 1 in a fully-expanded configuration with the support surface assemblies not removed.

FIG. 5 shows the shelving system 10 in the fully expanded in-line configuration without the support surface assemblies 22 removed. In many embodiments, the support surface assemblies 22 are coupled with the underlying support platforms at suitable locations (e.g., along the ends and at intermediate points along the lengthwise edge) such that the planform of the support surface assemblies is constrained to conform to the planform of the underlying support platforms.

Figure 6:
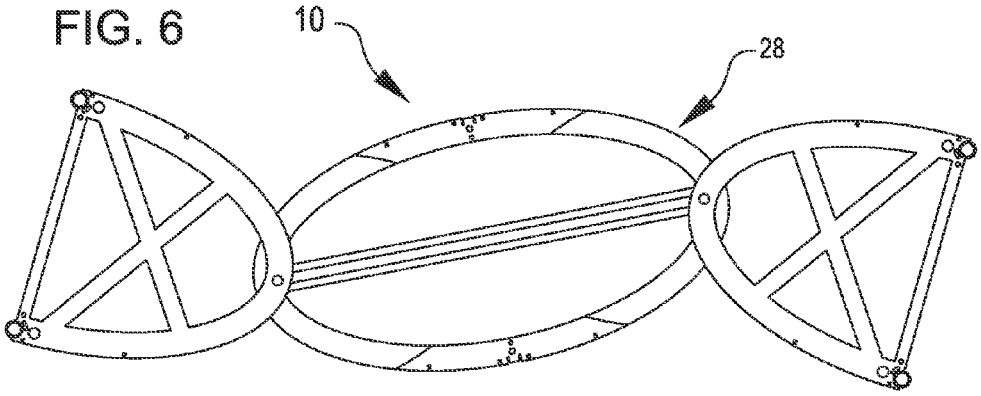
FIG. 6 is a top view of the variable-planform shelving system of FIG. 1 in a fully-expanded and curved configuration with the support surface assemblies removed to show details of the underlying shelf variable support platforms and the variable base.
Figure 7:
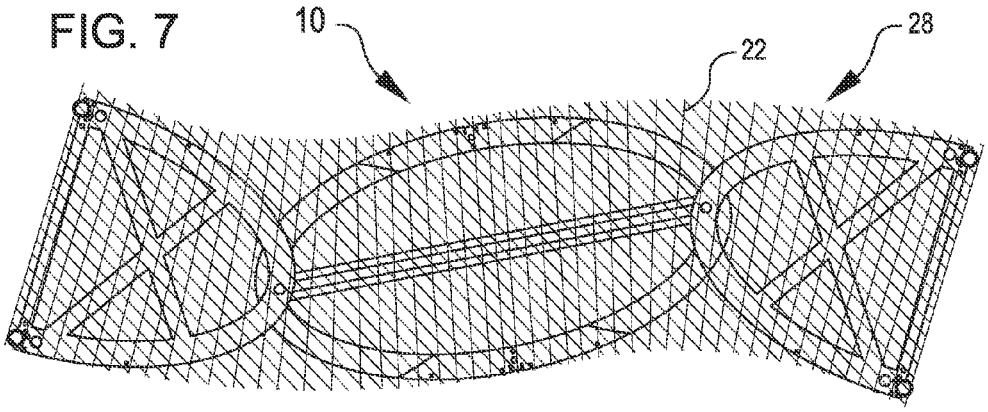
FIG. 7 is a top view of the variable-planform shelving system of FIG. 1 in the configuration of FIG. 6 with the support surface assemblies not removed.
Figure 8:
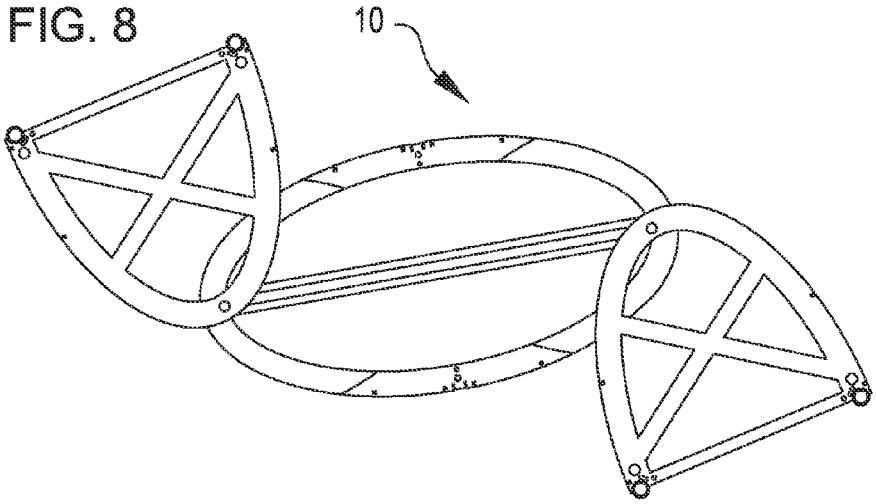
FIG. 8 is a top view of the variable-planform shelving system of FIG. 1 in another fully-expanded and curved configuration with the support surface assemblies removed to show details of the underlying shelf variable support platforms and the variable base.
Figure 9:
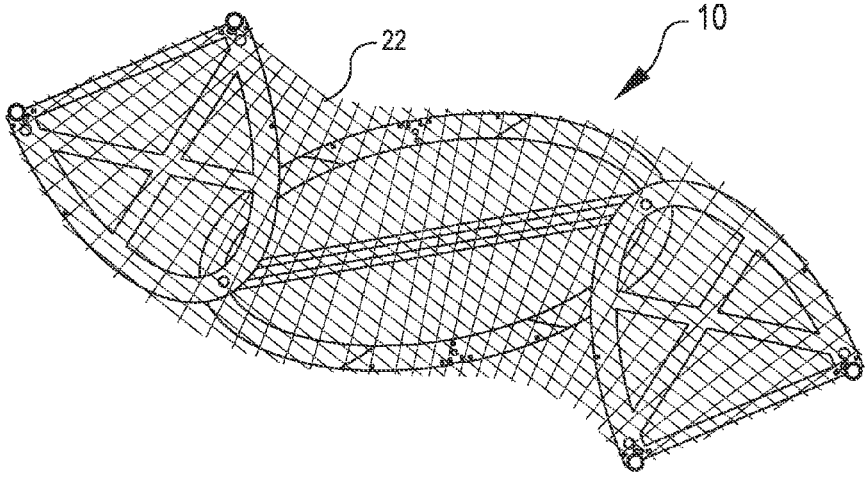
FIG. 9 is a top view of the variable-planform shelving system of FIG. 1 in the configuration of FIG. 8 with the support surface assemblies not removed.
Figure 10:
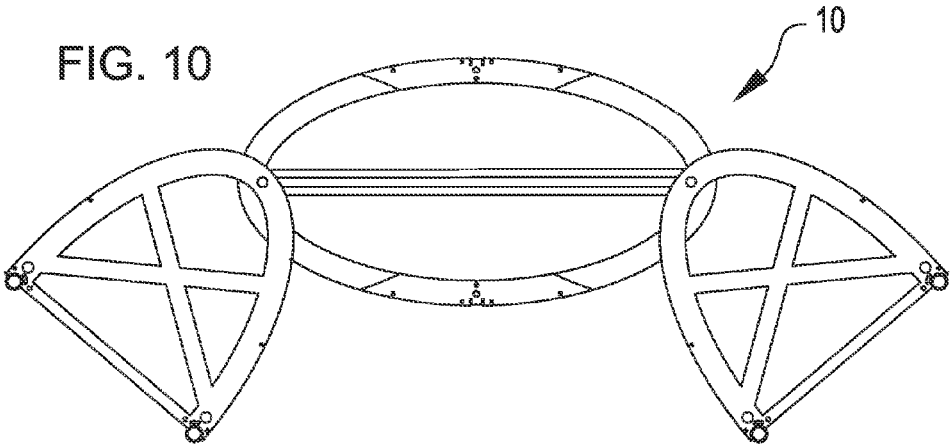
FIG. 10 is a top view of the variable-planform shelving system of FIG. 1 in another fully-expanded and curved configuration with the support surface assemblies removed to show details of the underlying shelf variable support platforms and the variable base.
Figure 11:
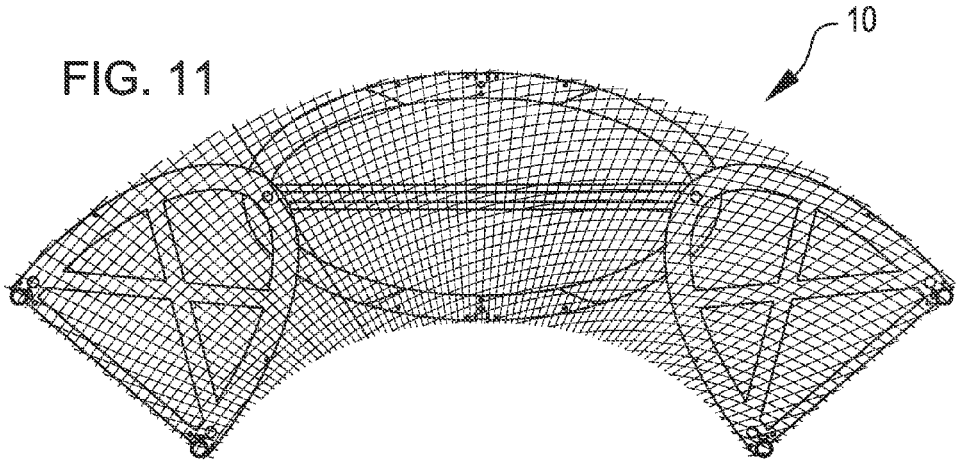
FIG. 11 is a top view of the variable-planform shelving system of FIG. 1 in the configuration of FIG. 10 with the support surface assemblies not removed.

FIG. 6 shows the shelving system 10 in a fully expanded curved configuration with the support surface assemblies 22 not shown to better illustrate the relative orientations between the frames of the base support platform 26 and the variable support platforms 28. FIG. 7 shows the same configuration with the support surface assemblies not removed. As shown, the planform of the variable support surface assemblies 22 varies to conform to the planform of the underlying support platforms. FIG. 8 and FIG. 9 show the shelving system 10 in another fully expanded curved configuration. And FIG. 10 and FIG. 11 show the shelving system 10 in yet another fully expanded curved configuration.

Figure 12:
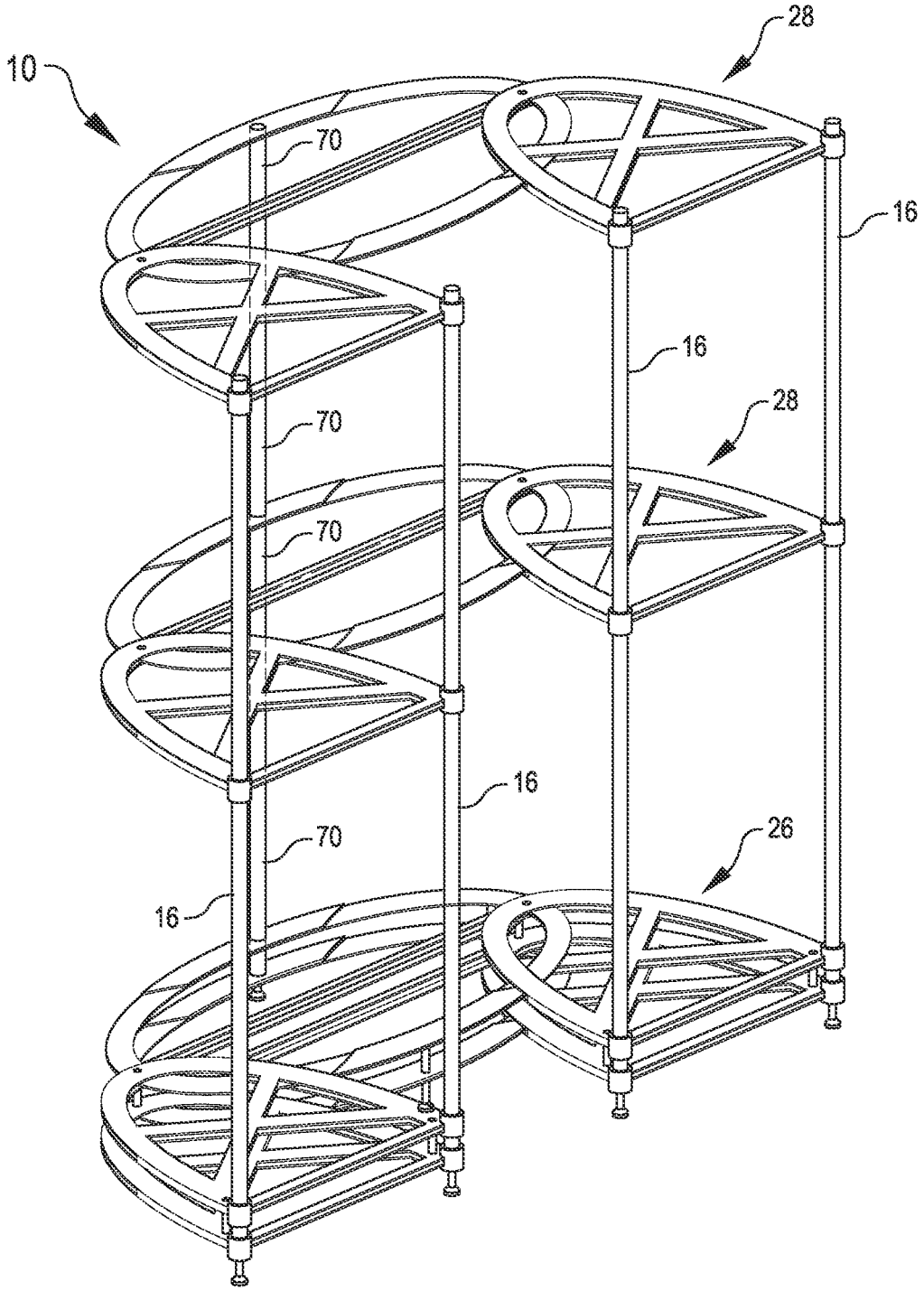
FIG. 12 is a perspective view of the variable-planform shelving system of FIG. 1 in another fully-expanded and curved configuration with an additional support member and the support surface assemblies removed to show details of the underlying shelf variable support platforms and the variable base.
Figure 13:
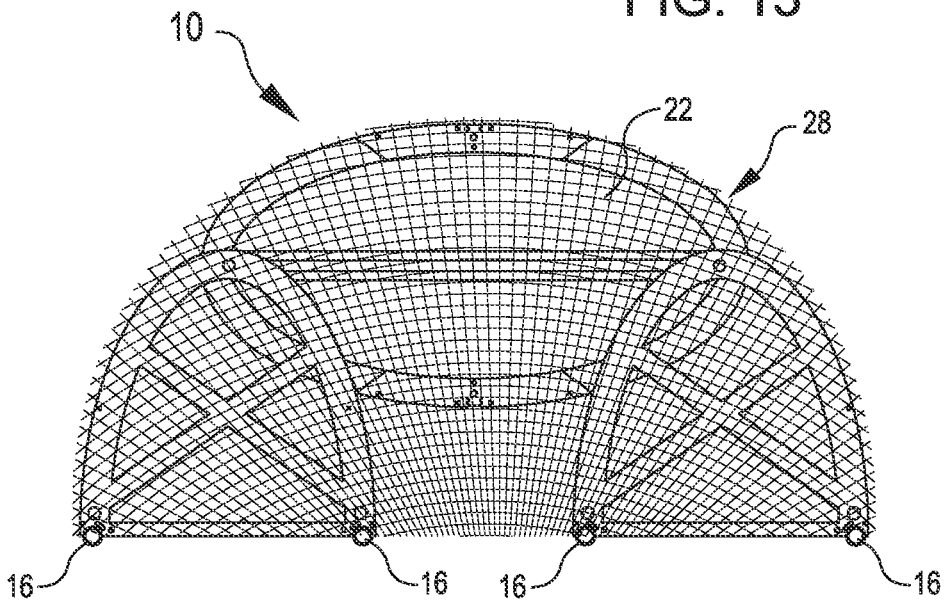
FIG. 13 is a top view of the variable-planform shelving system of FIG. 1 in the configuration of FIG. 12 with the support surface assemblies not removed and the additional support member not shown.

FIG. 12 shows the shelving system 10 (with the support surface assemblies 22 not shown) in another fully expanded curved configuration with a removable support column 70 added to provide additional support to the variable support platforms 28. In the configuration of FIG. 12, the support posts 16 are substantially aligned. In many embodiments, the connection between the support posts 16 and the variable support platforms 28 is configured to react mainly shear load. Accordingly, the removable support column 70 provides an additional support that is offset from the aligned support posts 16. With shear only connections between the variable support platforms 28 and the aligned support posts 16, the support column 70 provides required additional support to the variable support platforms 28. FIG. 13 shows the same configuration with the support surface assemblies 22 not removed and the support column 70 not shown. As can be seen, with shear load only type connections between the variable support platforms 28 and the aligned support posts 16, the support column 70 provides necessary offset support to the variable support platforms 28 to balance eccentricity between the items supported by the shelves and the aligned support posts 16.

Figure 14A:
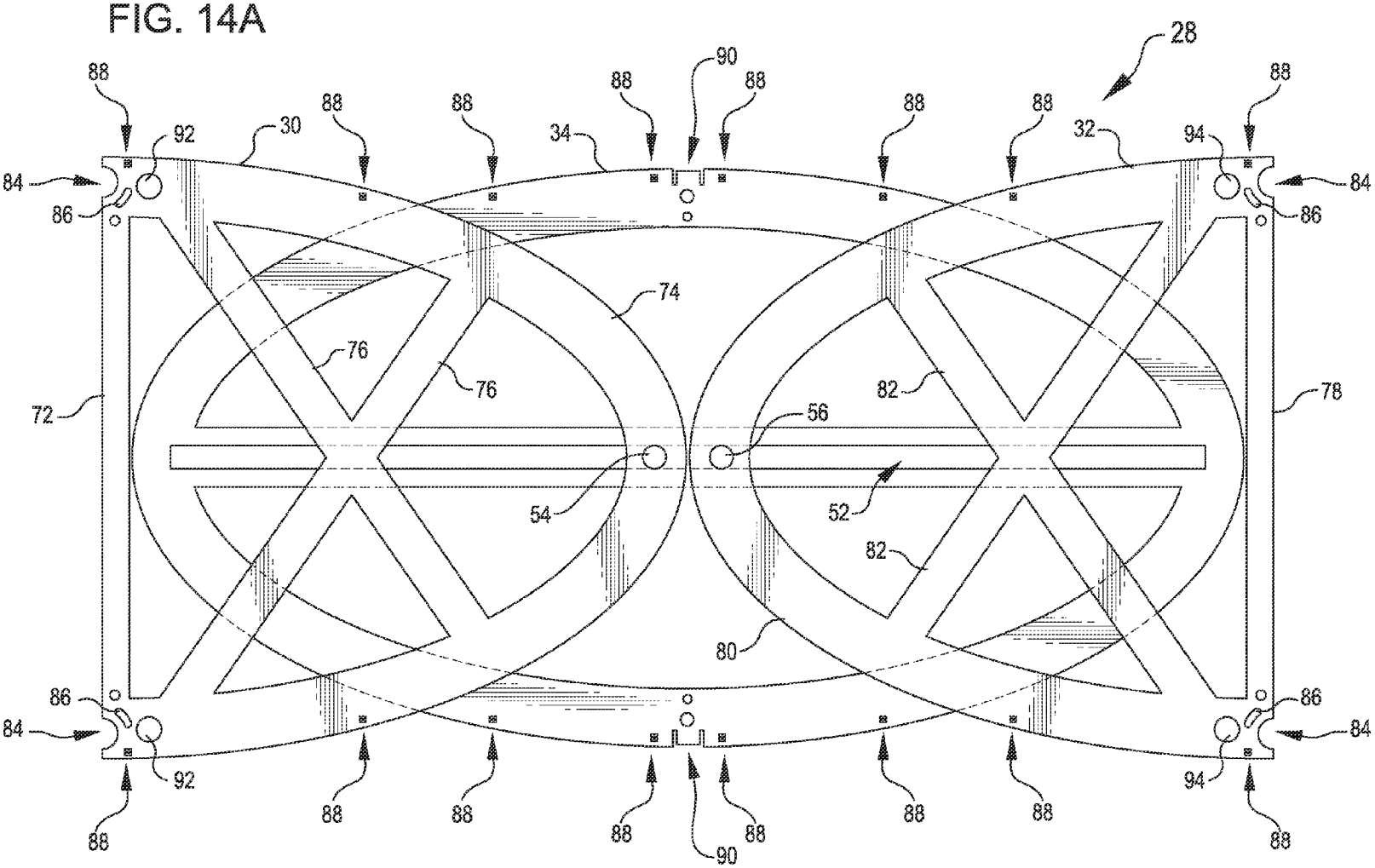
FIG. 14A is a plan view a variable support platform of the variable-planform shelving system of FIG. 1.

FIG. 14A shows a plan view of a variable support platform 28 in the compact collapsed configuration. The first frame 30 includes a straight base member 72, a half-elliptical perimeter member 74, and cross members 76. The perimeter member 74 and the cross members 76 are slotted so as to accommodate the illustrated end portion of the third frame 34. Likewise the second frame 32 includes a straight base member 78, a half-elliptical perimeter member 80, and cross members 82. The perimeter member 80 and the cross members 82 are slotted so as to accommodate the illustrated end portion of the third frame 34. At the corners of the first and second frames 30, 32, semi-circular recesses 84 are configured to accommodate the support posts 16. Adjacent to the semi-circular recesses 84, hanger apertures 86 are located to accommodate a portion of a supporting hanger bracket that is removably attached to one of the support posts 16. The hanger apertures 86 extend circumferentially around the recesses 84 for a limited extent so as to accommodate a suitable range of angular orientations of the support post 16 and the attached hanger bracket. The first, second, and third frames 30, 32, 34 include attachment apertures 88 that can be used to attach the price display assembly 20 shown in FIG. 1. And the third frame 34 includes attachment features 90 for the support column 70 shown in FIG. 12.

The central aperture 52 of the third frame 34 receives the coupling pins 54, 56, which are coupled with the first and second frames 30, 32 and extend across the slots in the first and second frames 30, 32, thereby extending through the central aperture 52. The central aperture 52 is configured to allow constrained movement of the third frame 34 relative to the first frame 30 and/or relative to the second frame 32, including changes in angular orientation of the third frame 34 relative to the first frame 30 and/or relative to the second frame 32.

The variable support platform 28 includes additional features that allows for its use as either the upper portion 36 of the base support platform 26 or the lower portion 38 of the base support platform 26. For example, the first frame 30 includes circular apertures 92 for the attachment of the column members 58 as shown in FIG. 4. The second frame 32 includes circular apertures 94 for the attachment of the column members 60. And the third frame 34 includes circular apertures 96 for the attachment of the column members 62.

Figure 14B:
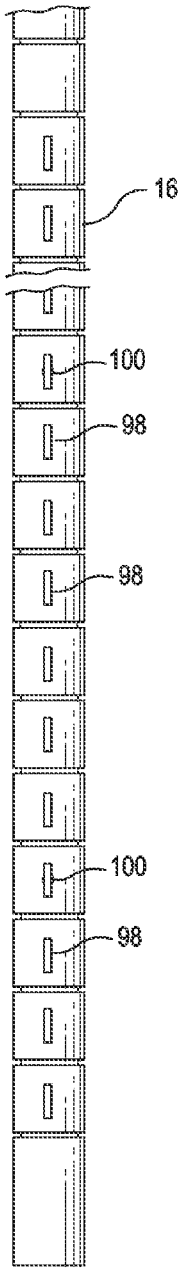
FIG. 14B is a fragmented, side view of a support post used in the variable-planform shelving system of FIG. 1.
Figure 14C:
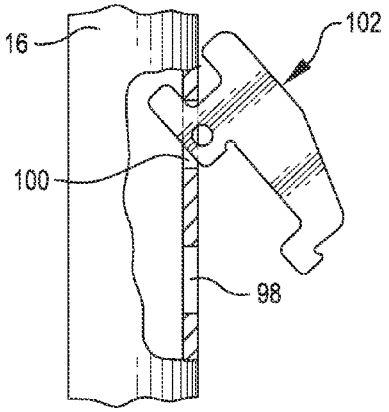
FIG. 14C is a fragmented, side view of a hanger bracket partially inserted in a first opening of a support post shown in FIG. 14B.
Figure 14D:
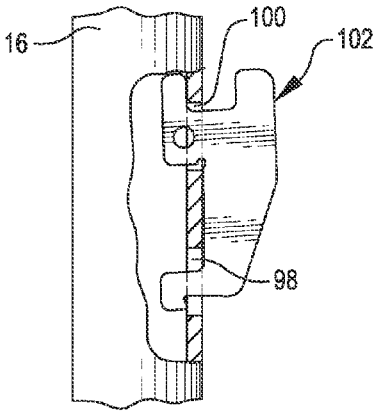
FIG. 14D is a fragmented, side view of a hanger bracket inserted in the first opening and a second opening of the support post shown in FIG. 14B resulting in a variable support platform supporting position.
Figure 14E:
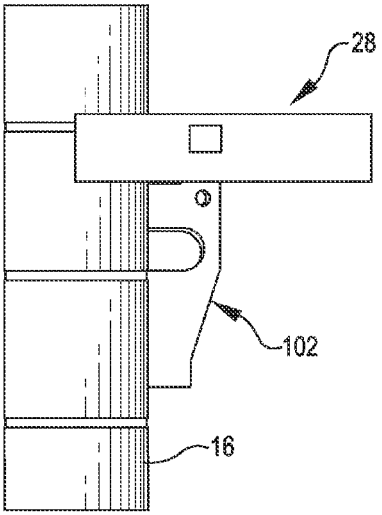
FIG. 14E is a side view of a hanger bracket attached to a support post and supporting a corner of a variable support platform of the variable-planform shelving system of FIG. 1.

FIG. 14B through FIG. 14E show details of how a variable support platform 28 is supported from one of the support posts 16. FIG. 14B shows bracket-receiving slots 98, 100 in the support posts 16. In many embodiments such as the one shown, the support posts 16 have a plurality of bracket-receiving slots at regular intervals, thereby providing for numerous combinations of numbers of shelves and/or spacing of shelves. FIG. 14C shows a hanger bracket 102 partially inserted in a first opening 100 of the support post 16. FIG. 14D shows the hanger bracket 102 attached to the support post 16. And FIG. 14E shows a close-up side view of the hanger bracket 102 attached to one of the support posts 16 and supporting a corner of a variable support platform 28. Additional details of a suitable approach for supporting the variable planform shelves 14 are described in U.S. Pat. No. 5,415,302, entitled "MODULAR SHELVING SYSTEM WITH A QUICK-CHANGE SHELF FEATURE," the entire disclosure of which is hereby incorporated by reference herein.

Figure 15:
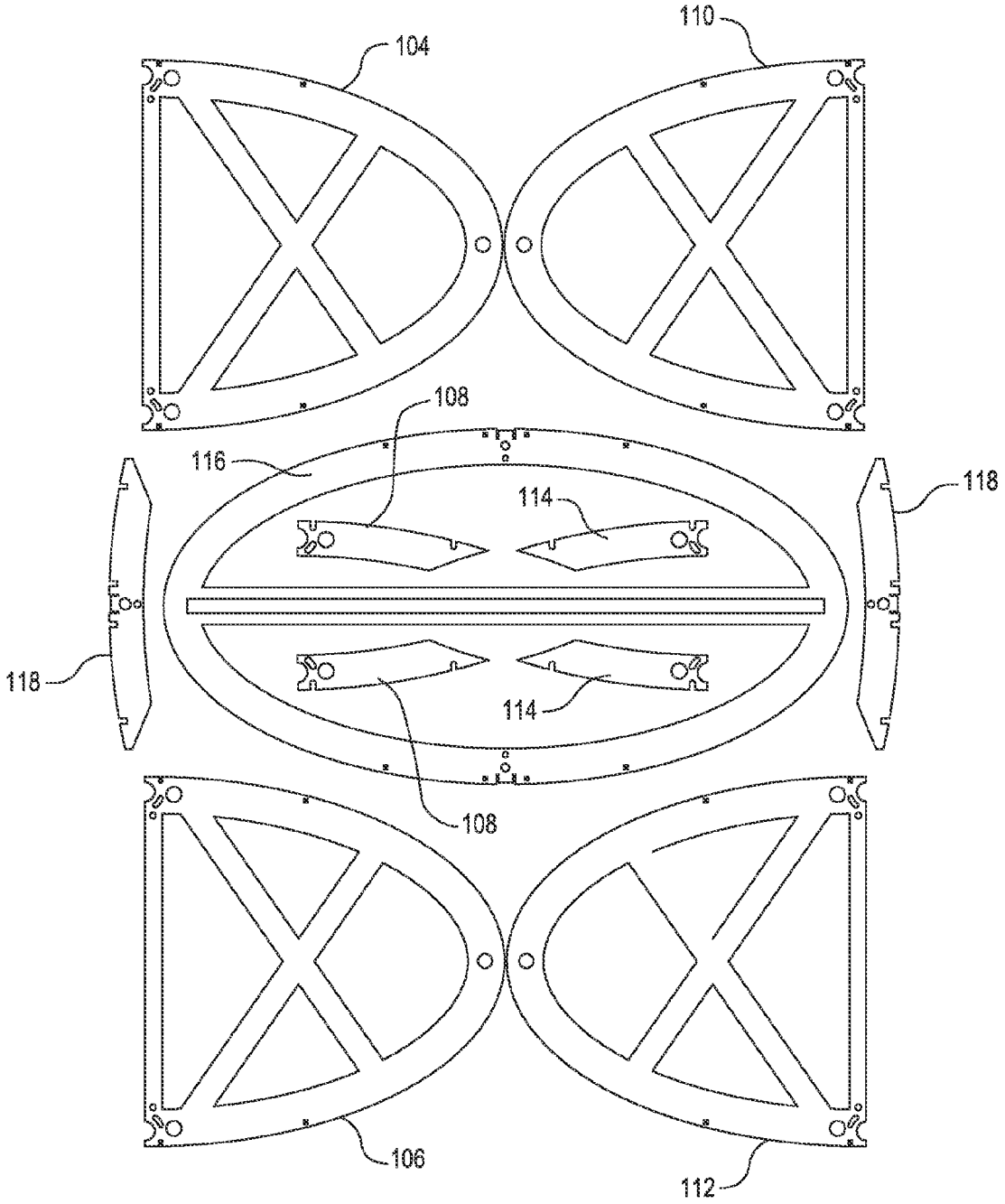
FIG. 15 is a plan view of components of frames of the variable support platform of FIG. 14A.

Any suitable fabrication method and material can be used to make the variable support platform 28. For example, in many embodiments, the first, second, and third frames 30, 32, 34 of the variable support platform 28 are made from components cut (e.g., using a water-jet) from a suitable constant thickness sheet of material. FIG. 15 shows a plan view of components that can be used to make the first, second, and third frames 30, 32, 34 of the variable support platform 28. The first frame 30 can be made from a first upper component 104, a first lower component 106, and first spacer components 108. The first spacer components 108 are disposed between the first upper and first lower components 104, 106 so that the outer perimeter and common features of these components are aligned. The first spacer components 108 serve to separate the first upper and first lower components 104, 106 so as to form the slot that receives part of the third frame 34. In the same way, the second frame 32 can be made from a second upper component 110, a second lower component 112, and second spacer components 114. The second spacer components 114 are disposed between the second upper and second lower components 110, 112 so that the outer perimeter and common features of these components are aligned. The second spacer components 114 serve to separate the second upper and second lower components 110, 112 so as to form the slot that receives part of the third frame 34. The third frame 34 can be made from a third frame component 116 and third spacer components 118. The third spacer components 118 are disposed on top of the third frame component so that the outer perimeter and common features of these components are aligned. The third spacer components 118 provide an upper surface to the third frame 34 that is in plane with the upper surfaces of the first and second frames 30, 32. Any suitable method for joining the components can be used (e.g., bonding, welding, brazing, fastening).

Figure 16:
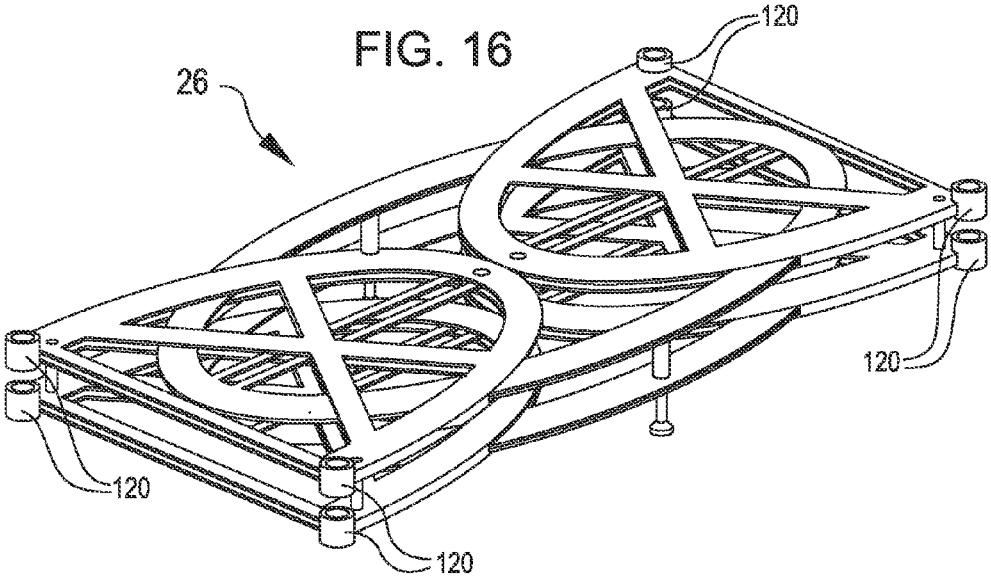
FIG. 16 is a perspective view of a variable base assembly of the variable-planform shelving system of FIG. 1 in the compact collapsed configuration of FIG. 1 with the associated support surface assembly removed to show details of the variable base assembly.

Additional details of the variable support base 26 will now be described with references to FIG. 16. The variable support base 26 includes two cylindrical sleeves 120 at each corner. The sleeves 120 interface with the support posts 16 and rigidly tie the support posts to the variable support base 16, thereby stiffening the shelving system 10 against lateral deflection of the shelves 14 relative to the variable support base 26.

Figure 17:
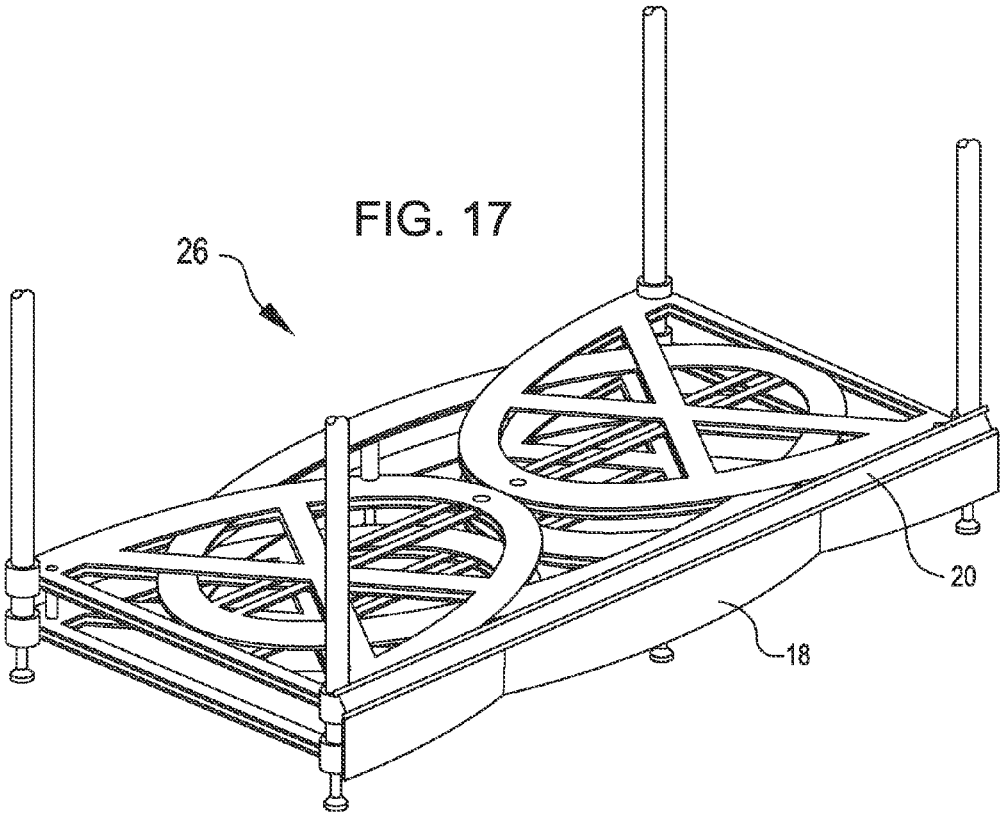
FIG. 17 is a perspective view of a kick plate assembly and a price display assembly of the variable-planform shelving system of FIG. 1.
Figure 18:
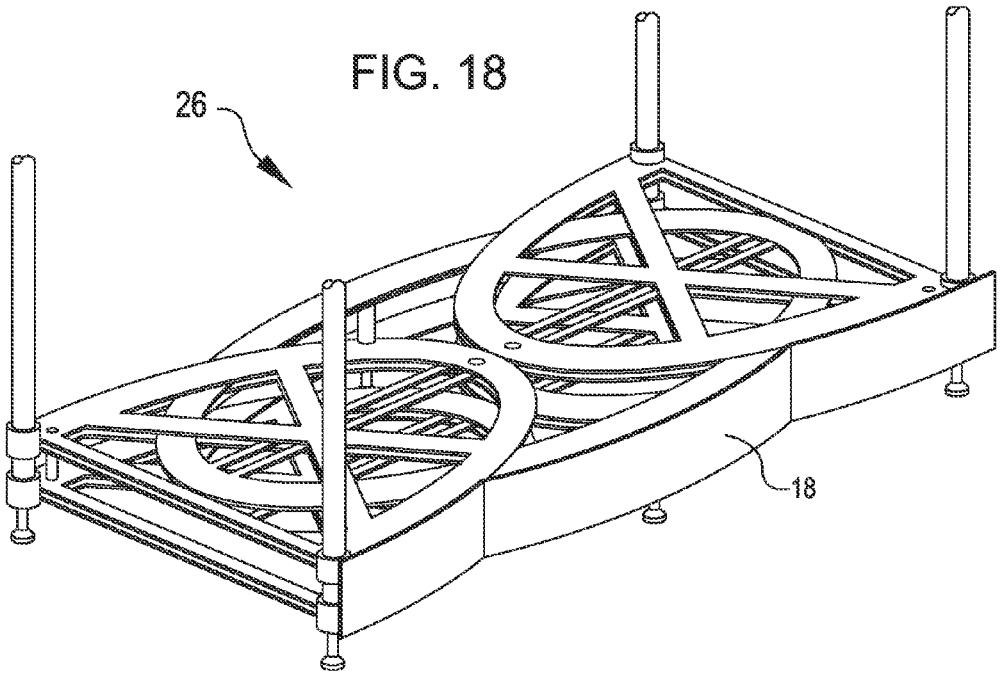
FIG. 18 is a perspective view of the kick plate assembly of FIG. 17 with the price display assembly removed.

Details of the kick plate assembly 18 and the price display assembly 20 will now be described with reference to FIG. 17 through FIG. 28. Both the kick plate assembly 18 and the price display assembly 20 are configured to expand and conform to all of the possible planform configurations of the base support platform 26. FIG. 17 shows the kick plate assembly 18 and the price display assembly 20 attached to the base support platform 26 in the compact collapsed configuration. FIG. 18 shows the kick plate assembly 18 attached to the base support platform 26 with the price display assembly 20 not shown.

Figure 19:
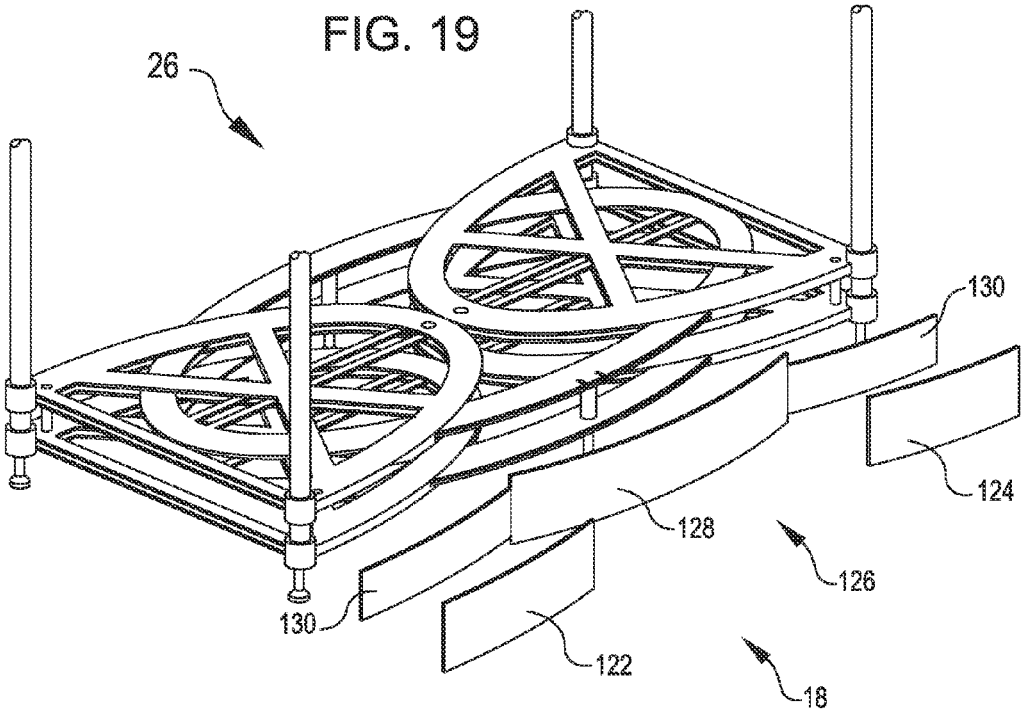
FIG. 19 is an exploded perspective view of the kick plate assembly of FIG. 17.

FIG. 19 shows an exploded perspective view of the kick plate assembly 18. The kick plate assembly 18 includes a first kick plate segment 122, a second kick plate segment 124, and a third kick plate segment 126. The first kick plate segment 122 attaches to the first upper and first lower frames 40, 46 of the base support platform 26. The second kick plate segment 124 attaches to the second upper and second lower frames 42, 48 of the base support platform 26. And the third kick plate segment 126 attaches to the third upper and third lower frames 44, 50 of the base support platform 26. The first and second kick plate segments 122, 124 have thin rectangular bodies and can be made to be flexible or inflexible. The first and second kick plate segments 122, 124 cover fixed regions of the base support platform 26 corresponding to forward facing exposed edges of the first upper and first lower frames 40, 46 and of the second upper and second lower frames 42, 48, respectively. The third kick plate segment 126 includes a central portion 128 and side extensions 130. The central portion 128 covers a fixed region of the base support platform 26 corresponding to forward facing exposed edges of the third upper and third lower frames 44, 50. When the base support platform 26 is in the compact collapsed configuration (as shown), the side extensions extend behind and are fully covered by the first and second kick plate segments 122, 124. When the base support platform 26 is in an expanded configuration, the side extensions cover forward facing portions of the base support platform 26 disposed between the central portion 128 and each of the first and second kick plate segments 122, 124. The third kick plate segment 126 can be made suitably flexible such that the side extensions are able to conform to all of the various planform configurations of the base support platform 26.

Additional features of the kick plate assembly 18 are shown in FIG. 20 through FIG. 22. FIG. 20 is a rear perspective view showing a portion of the first kick plate segment 122 and a portion of the third kick plate segment 126. FIG. 21 is a rear perspective view showing a portion of the second kick plate segment 124 and a portion of the third kick plate segment 126. Each of the first, second, and third kick plate segments 122, 124, 126 have barbed attachment features 132 that extend rearward from the aft face of the segment. The barbed attachment features 132 are sized and configured to be accommodated by and engage with the attachment apertures 88 (as shown in FIG. 14A) in the base support platform 26 so as to attach the kick plate assemblies 122, 124, 126 to the base support platform 26. The attachment features 132 in the first and second kick plate segments 122, 124 are located to accommodate and optionally support the side extensions 130 of the third kick plate segment 126 there between. FIG. 22 shows the kick plate assembly 18 in an expanded configuration and illustrates the coverage provided by the side extensions 130.

Figure 23:
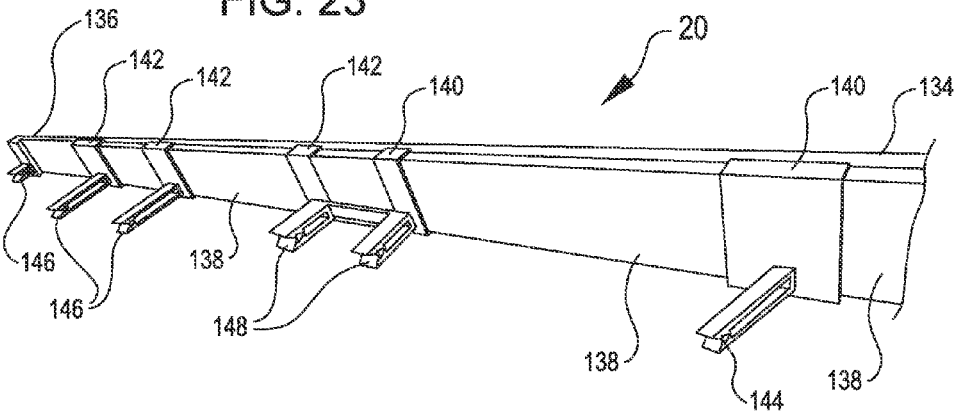
FIG. 23 through FIG. 25 are perspective views of the price display assembly of FIG. 17 in the compact collapsed configuration of FIG. 1.
Figure 24:
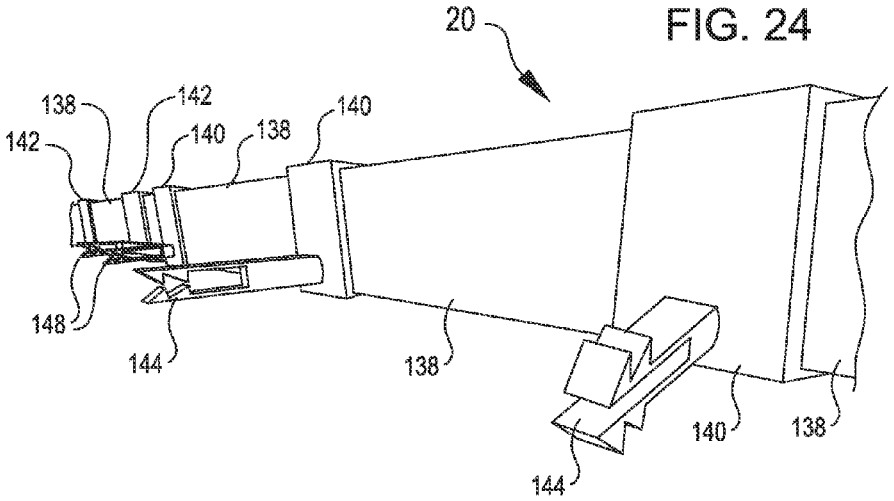
Figure 25:
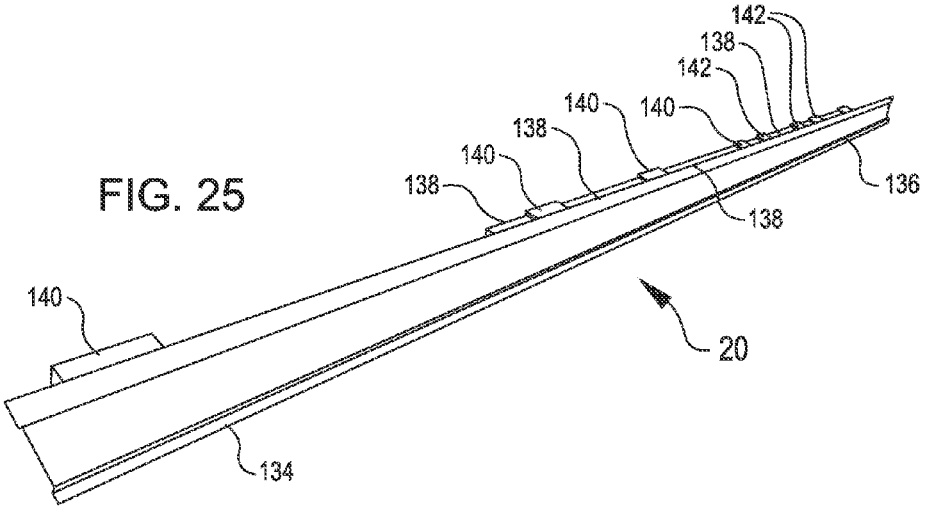
Figure 26:
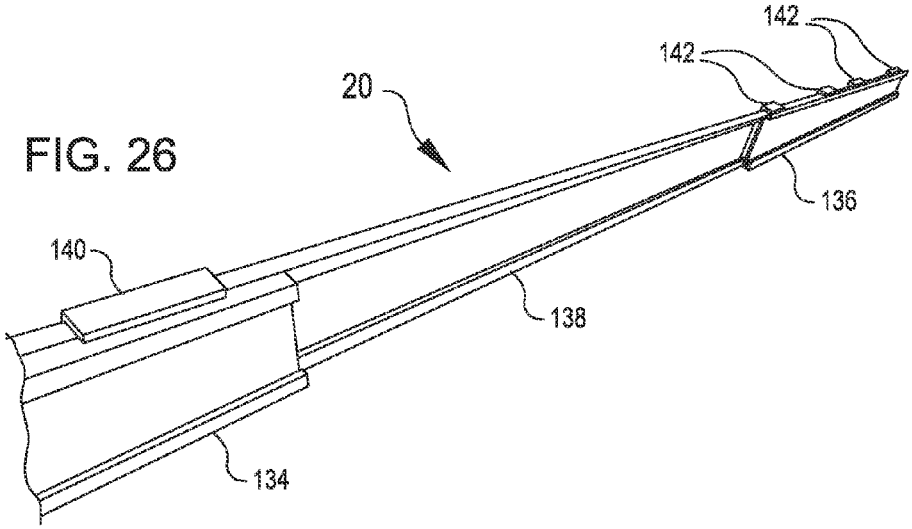
FIG. 26 is a perspective view of the price display assembly of FIG. 17 in an expanded configuration.
Figure 27:
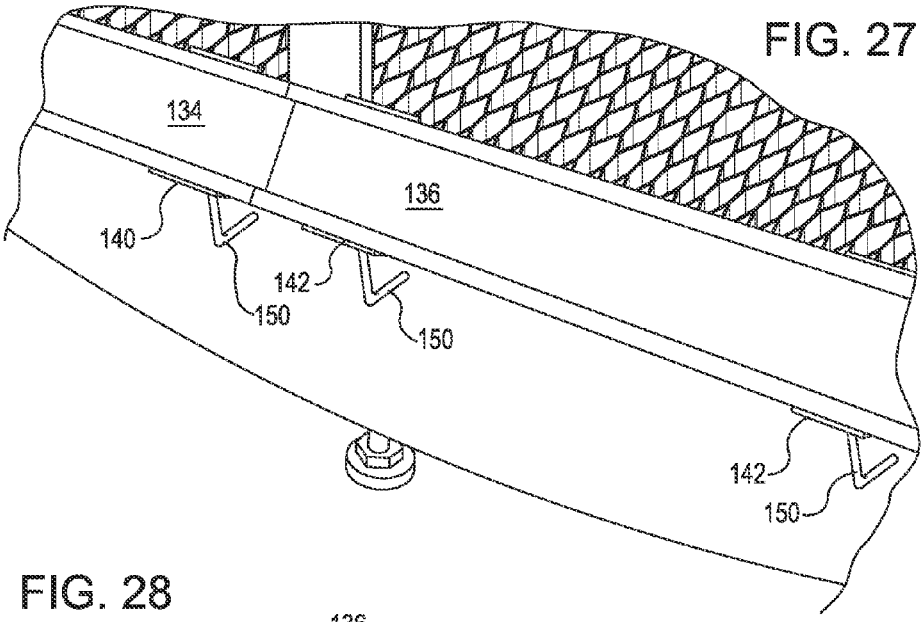
FIG. 27 and FIG. 28 are close-up perspective views showing details of the variable-planform shelving system of FIG. 1 in the compact collapsed configuration of FIG. 1.
Figure 28:
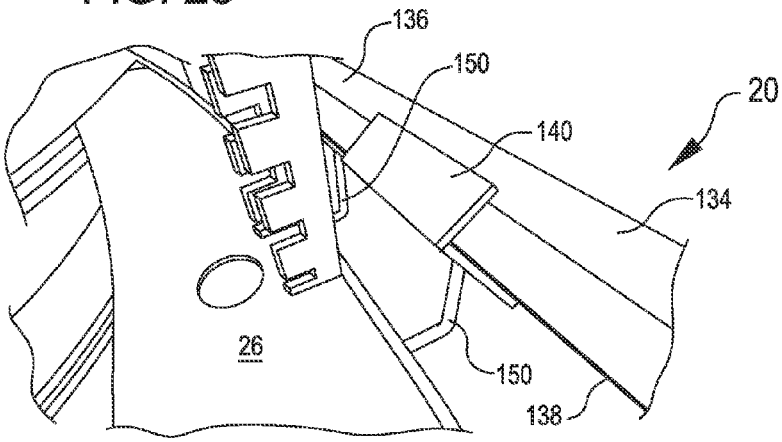

FIG. 23 through FIG. 28 show details of the price display assembly 20, in accordance with many embodiments. FIG. 23 and FIG. 24 show rear perspective views of an embodiment of the price display assembly 20 that is configured to attach to the attachment apertures 88 (as shown in FIG. 14A) in the variable support platform 28. FIG. 25 shows a front perspective view of the price display assembly 20. The price display assembly 20 includes a first display segment 134, a second display segment 136, and a flexible third display segment 138 that is slidably received through rectangular frame portions 140, 142 of the first and second display segments 134, 136, respectively. The first display segment 134 includes barbed attachment features 144 that extend rearward from the aft face of the first display segment 134. The second display segment 136 includes barbed attachment features 146 that extend rearward from the aft face of the second display segment 136. And the third display segment 138 includes barbed attachment features 148 that extend rearward from the aft face of the third display segment 138. The attachment features 144, 146, 148 are sized and configured to be accommodated by and engage with the attachment apertures 88 (as shown in FIG. 14A) in the variable support platform 28 so as to attach the price display assembly 20 to the variable support platform 28. The first display segment 134 is attached to the first frame 30; the second display segment 136 is attached to the second frame 32; and the third display segment 138 is attached to the third frame 34. When the variable support platform 28 is reconfigured, the flexible third display segment 138 slides relative to the first display segment 134 and/or relative to the second display segment 136 through the rectangular frame portions 140, 142 of the first and second display segments 134, 136, while still remaining engaged through at least one of the rectangular frame portions 140, 142 in each of the first and second display segments 134, 136. Any misalignment between the first and second display segments 134, 136 is accommodated by flexure of the flexible third display segment 138. FIG. 26 shows the price display assembly 20 in an expanded configuration and illustrates the price display coverage provided by the third display segment 138 between the first and second display segment 134, 136. FIG. 27 and FIG. 28 show an embodiment of the price display assembly 20 configured to be mounted to the base support platform 26 via support beams 150 extending from the rectangular frame portions 140, 142.

Figure 29:
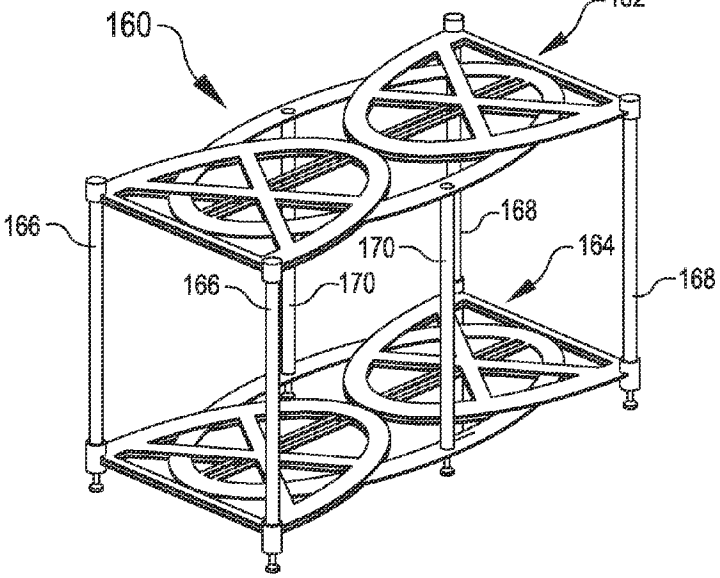
FIG. 29 is a perspective view of a table having a variable planform with a support surface assembly removed to better show underlying details, in accordance with many embodiments.

FIG. 29 shows a variable planform table 160 with a support surface assembly removed to better show underlying details, in accordance with many embodiments. The table 160 includes a variable support platform 162; a variable base 164; first intermediate members 166, second intermediate members 168 and third intermediate members 170. The variable support platform 162 and the variable base 164 are configured similar to the variable support platform 28 described herein. In many embodiments, the table 160 includes a support surface assembly 22 (not shown) supported by the variable support platform 162. And in many embodiments, the table 160 includes a support surface assembly 22 (not shown) supported by the variable base 164. In similar manner to the variable shelving system 10 described herein, the table 160 can be reconfigured into different planforms having different sizes and shapes.

Figure 30:
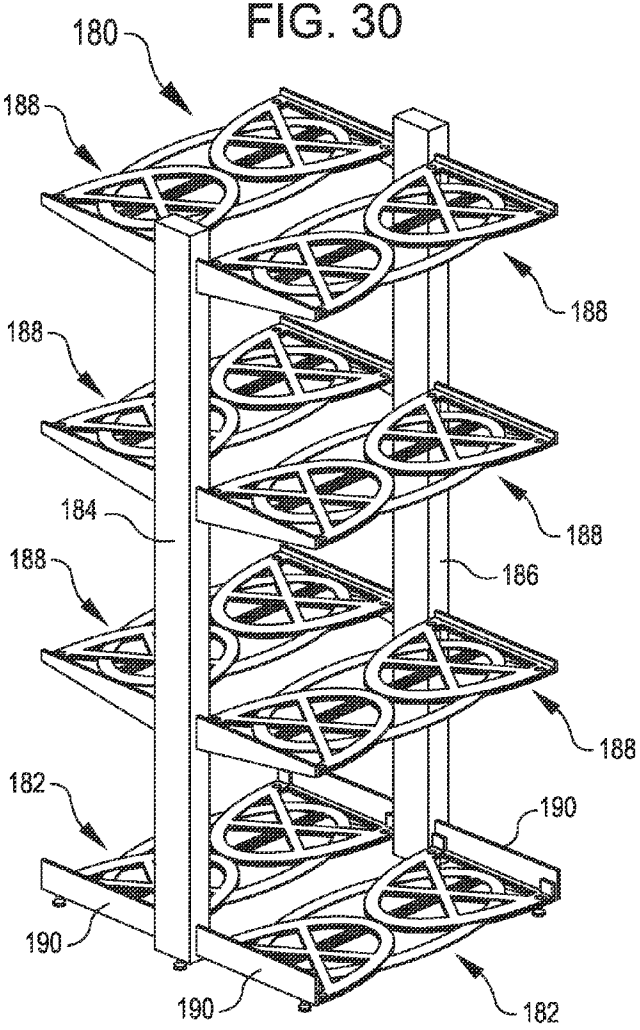
FIG. 30 is a perspective view of another variable-planform shelving system in a compact collapsed configuration with support surface assemblies removed to better show underlying details, in accordance with many embodiments.
Figure 31:
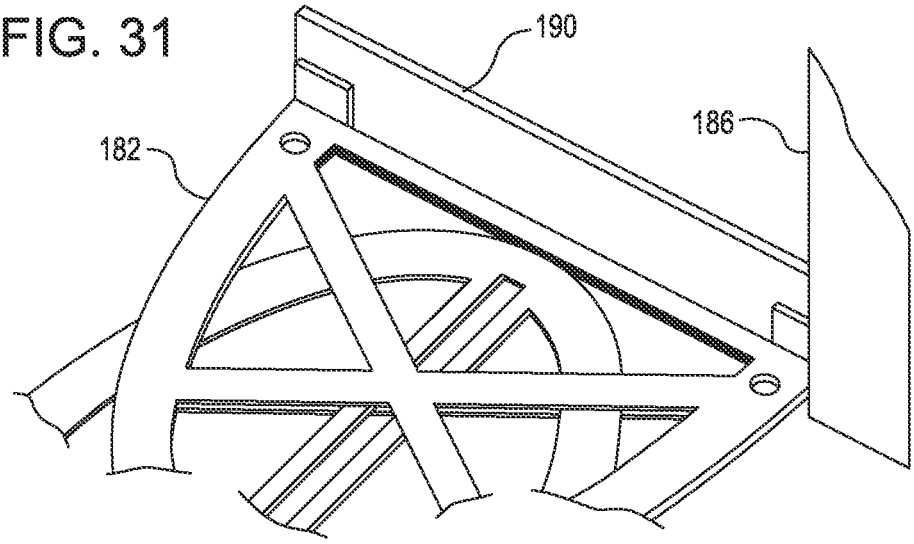
FIG. 31 is a close-up perspective view showing details of a base support platform of the variable-planform shelving system of FIG. 30.
Figure 32:
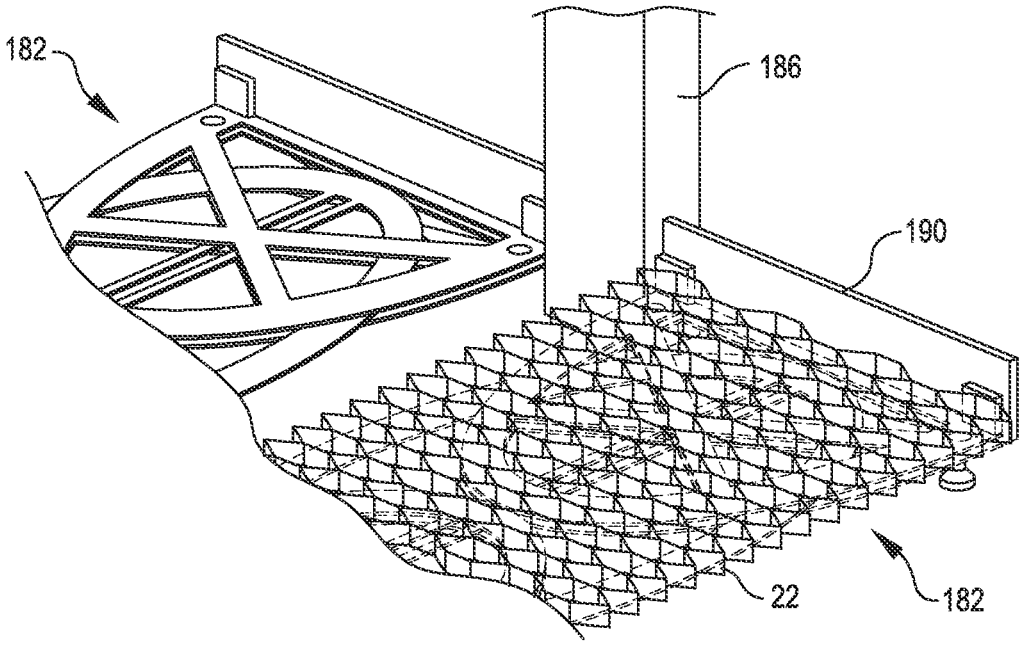
FIG. 32 is a close-up perspective view showing details of a support surface assembly of the variable-planform shelving system of FIG. 30.
Figure 33:
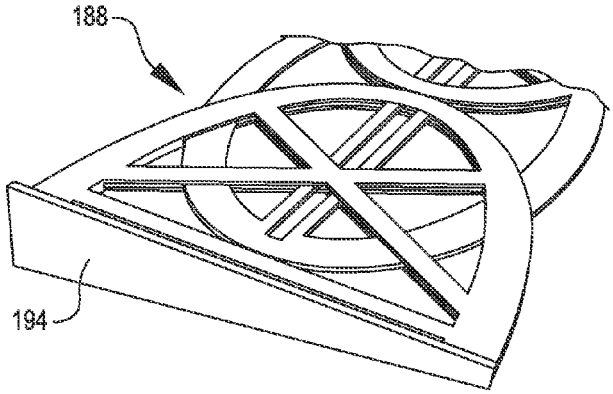
FIG. 33 is a close-up perspective view showing details of a variable support platform of the variable-planform shelving system of FIG. 30.

FIG. 30 shows another variable-planform shelving system 180, in accordance with many embodiments, in a compact collapsed configuration with support surface assemblies 22 removed to better show details of underlying features. The shelving system 180 includes base support platforms 182 and opposing support columns 184, 186 with variable support platforms 188 supported there from. The base support platforms 182 and the variable support platforms 188 are configured similar to the variable support platforms 28. FIG. 31 is a close-up perspective view showing connection details between a base support platform 182 and a base beam 190 rigidly attached to each of the support columns 184, 186. End frames of the base support platform 182 includes flanges 192 that are bolted to the base beam 190, thereby rigidly connecting the base support platform to the support columns 184, 186. FIG. 32 shows a support surface assembly 22 coupled to and supported by one of the base support platforms 182. FIG. 33 shows a close-up view of an end of one of the variable support platforms 188, which includes an integral end support beam 194. Each of the end support beams 194 is attached to and cantilevered from one of the support columns 184, 186.

Figure 34:
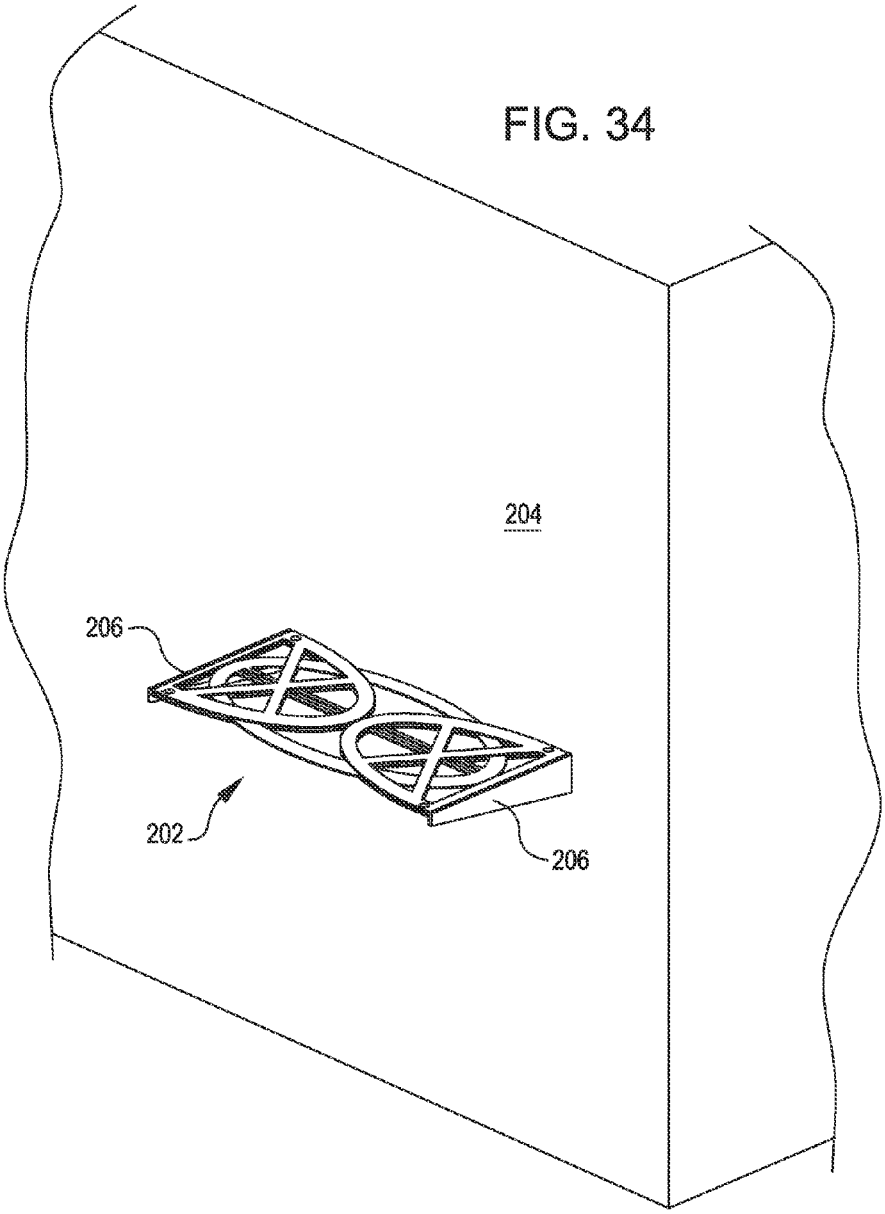
FIG. 34 is a perspective view of a variable support platform of a wall-mounted variable-planform shelf in a compact collapsed configuration, in accordance with many embodiments.
Figure 35:
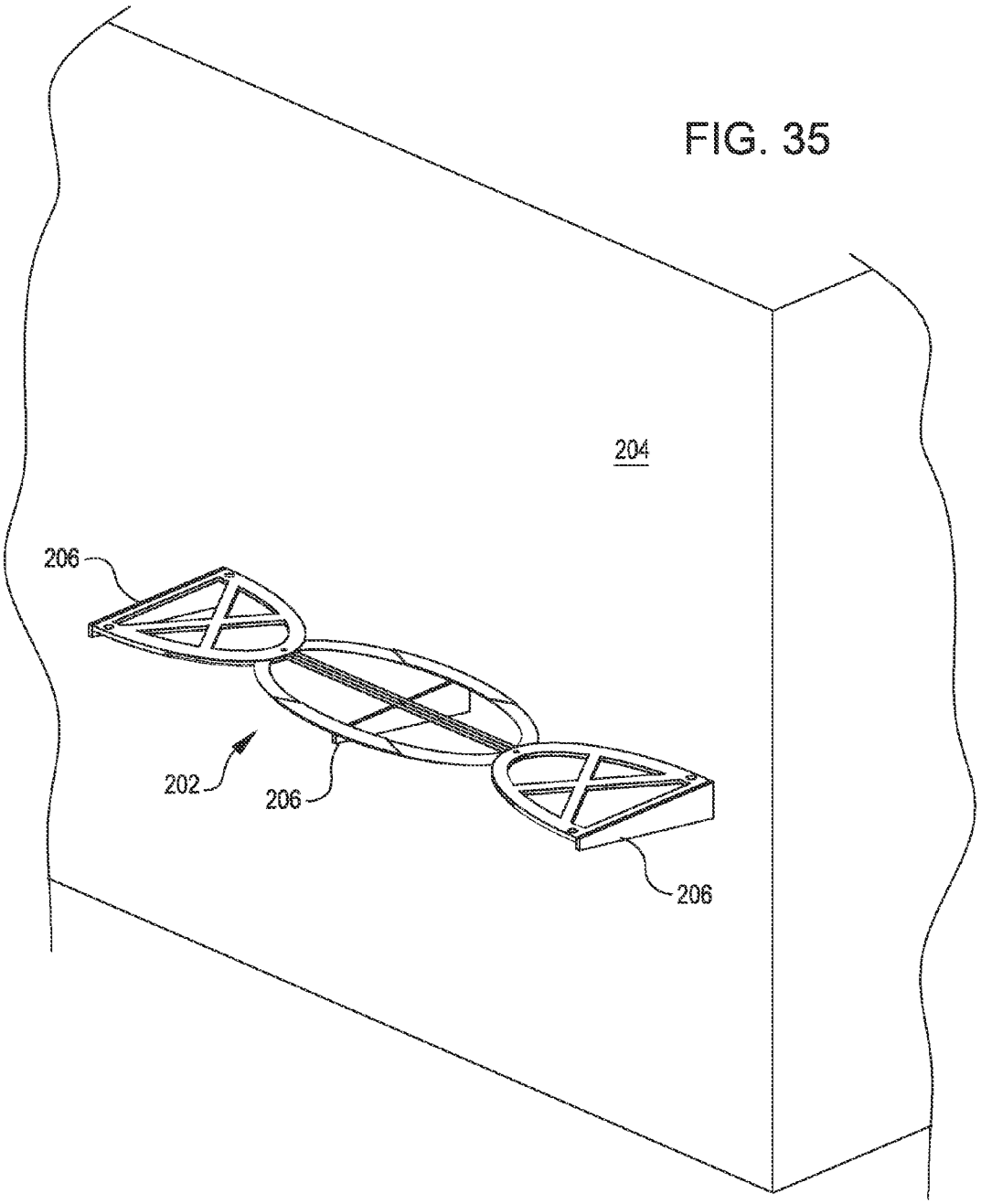
FIG. 35 is a perspective view of the variable support platform of FIG. 34 in an expanded configuration.
Figure 36:
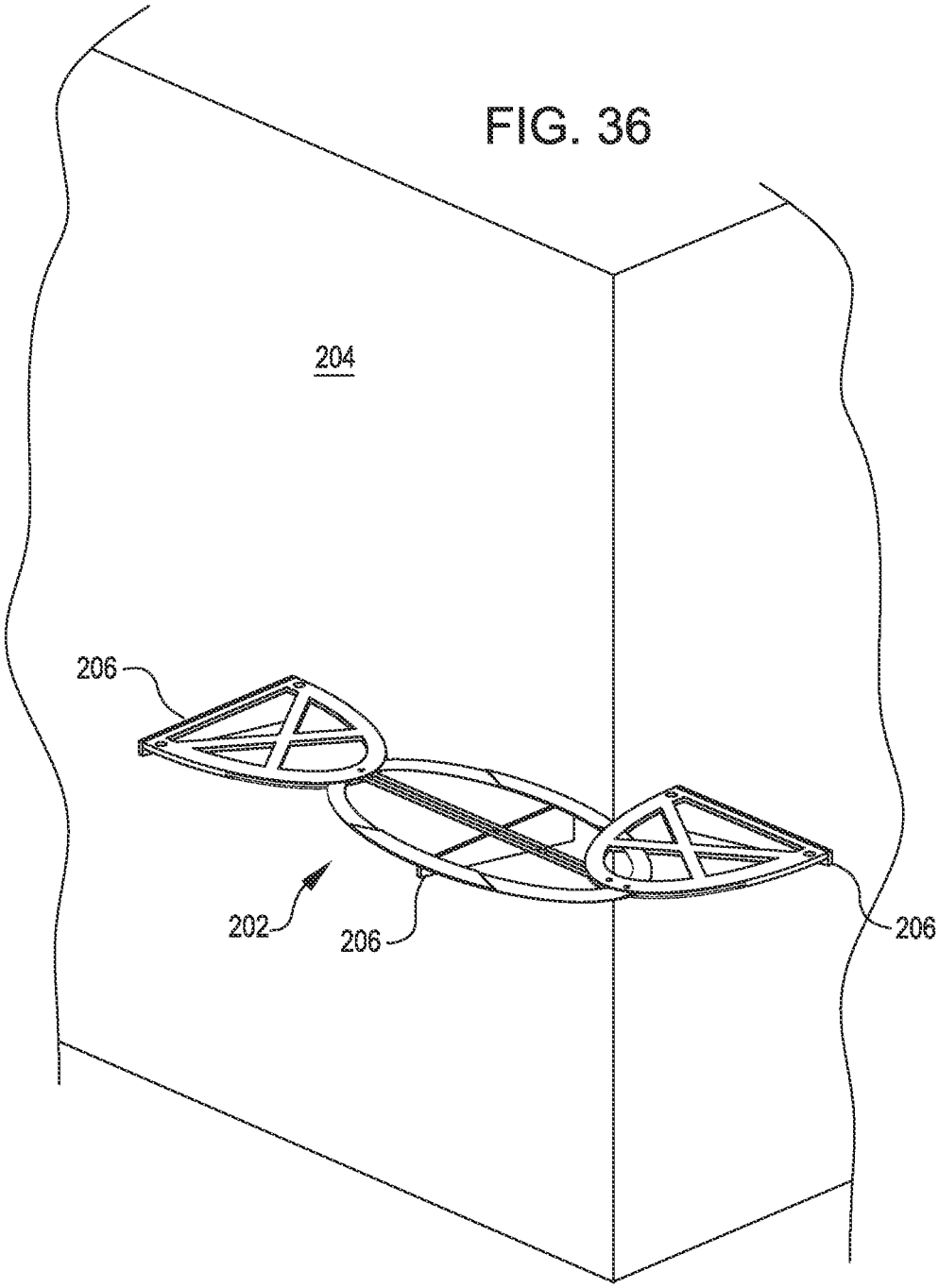
FIG. 36 is a perspective view of the variable support platform of FIG. 34 in an expanded configuration that wraps around an exterior corner of a wall.
Figure 37:
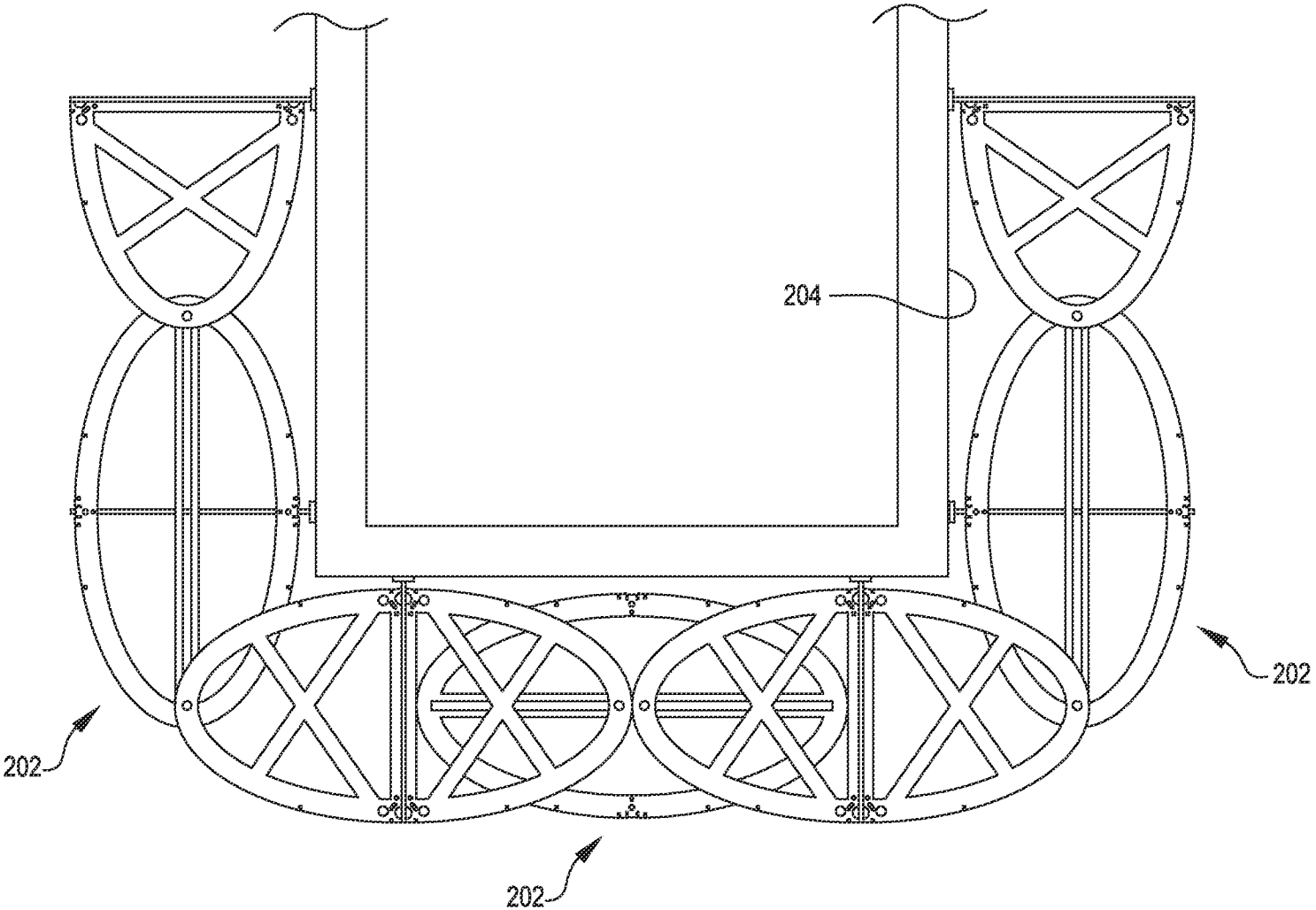
FIG. 37 is a plan view showing three variable support platforms of FIG. 34 installed to wrap around two exterior corners of a wall.

FIG. 34 through FIG. 36 show a wall-mounted variable-planform shelving system 200, in accordance with many embodiments. The shelving system 200 includes variable support platforms 202 that are configured similar to the variable support platforms 188. Each of the variable support platforms is attachable to a wall 204 via two or more support beams 206. For example, FIG. 34 shows a single variable support platform 202 in a compact collapsed configuration attached to the wall 204 via two support beams 206 disposed at opposing ends of the variable support platform 202. FIG. 35 shows a single variable support platform 202 in a fully-expanded configuration attached to the wall 204 via three support beams 206. FIG. 36 shows a single variable support platform 202 in a fully-expanded configuration that wraps around a corner of the wall 204. And FIG. 37 shows three variable support platforms 202 that wrap around two corners of the wall 204. As can be appreciated, the wall-mounted variable-planform shelving system 200 can be used and/or adapted for use with numerous wall configurations having different lengths, external corners, and/or internal corners.

Figure 38A:
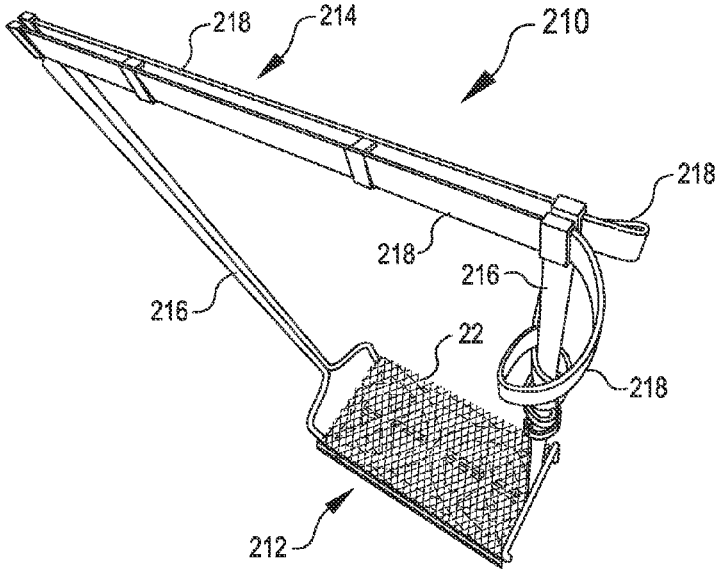
FIG. 38A and FIG. 38B are perspective views of a variable-length clothes rack having a variable-planform base, in accordance with many embodiments.
Figure 38B:
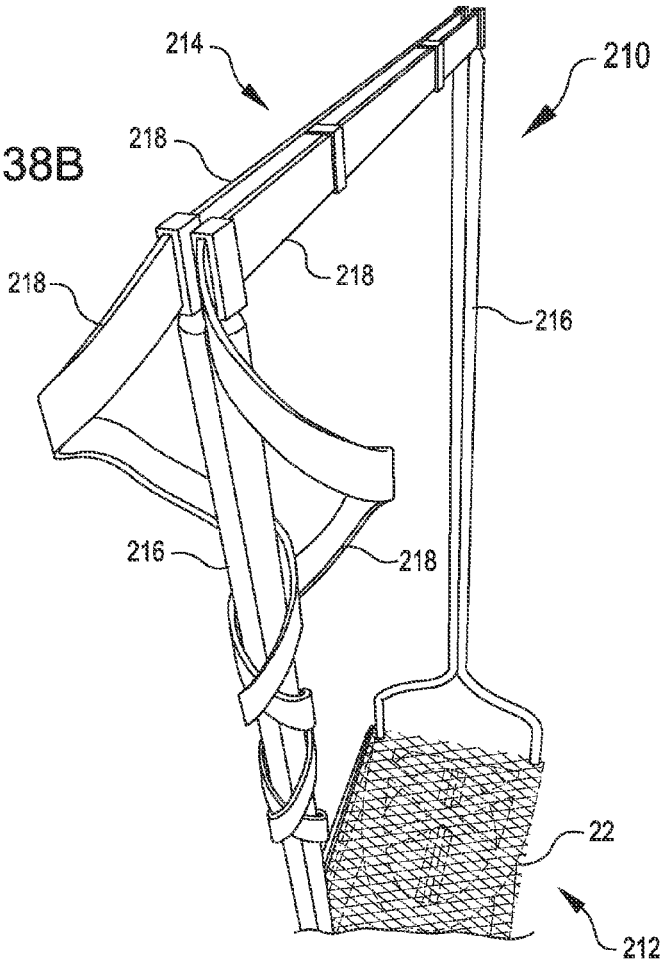

FIG. 38A and FIG. 38B show a variable-length clothes rack 210 having a variable-planform base 212, in accordance with many embodiments. The variable planform base 212 is configured similar to the variable planform base 12 described herein. Supported from the variable planform base 212 is an extendable top beam 214 from which clothes can be hung. The extendable top beam 214 can be reconfigured to various lengths corresponding to the various possible planforms of the variable planform base 212. The extendable top beam 214 is supported by two support columns 216, which are rigidly connected to opposing ends of the variable planform base 212. The extendable top beam 214 includes two flexible strap members 218, segments of which are held in tension between the tops of the support columns 216. For example, ends of the strap members 218 can be attached to the top of one of the support columns 216 and an intermediate location of each of the strap members 218 can be clamped to the top of the opposing support column 216 to maintain the tension in the strap members 218 between the tops of the support columns 216. As shown, the variable planform base 212 includes a support surface assembly 22 that can be used to support additional items (e.g., shoes, boots, etc.).

Figure 39A:
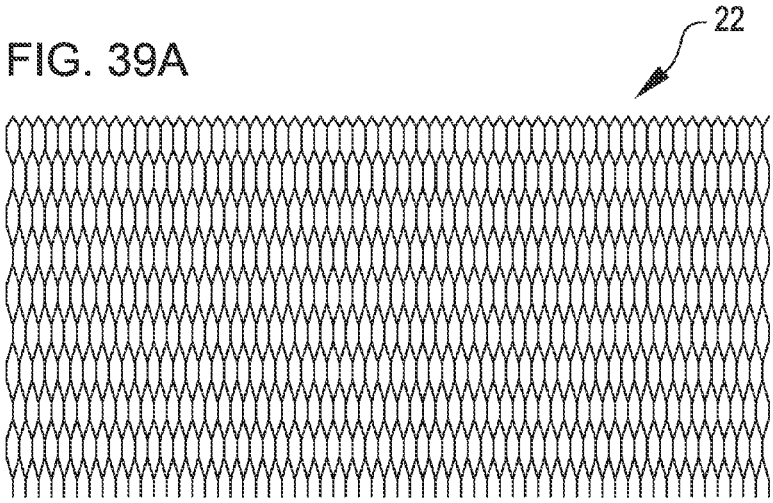
FIG. 39A is a plan view of a support surface assembly in an intermediate length configuration, in accordance with many embodiments.
Figure 39B:
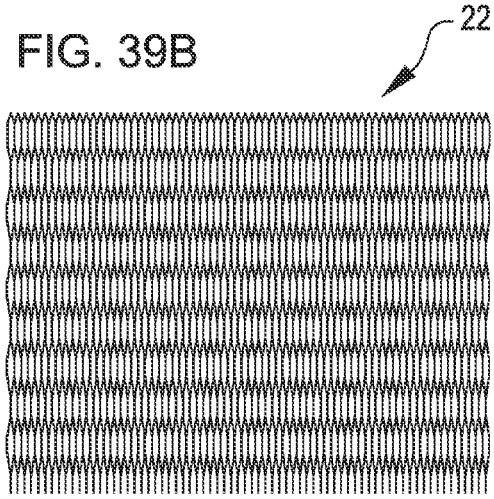
FIG. 39B is a plan view of the support surface assembly of FIG. 39A in a collapsed compact length configuration.
Figure 39C:
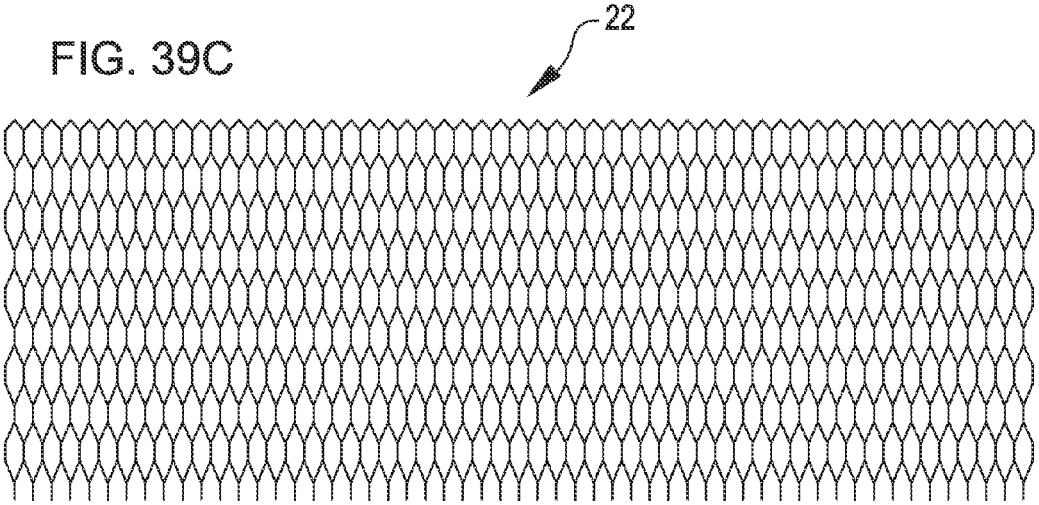
FIG. 39C is a close-plan view of the support surface assembly of FIG. 39A in an expanded length configuration.

FIGS. 39A, 39B, and 39C show plan views of the support surface assembly 22 in different expanded states. FIG. 39A shows the support surface assembly 22 in an intermediate length state corresponding to an intermediate length of the support surface assembly 22. The support surface assembly 22 is made from a plurality of flat panel members that extend vertically relative to view direction shown and are intermittently bonded together to a flexible and expandable assembly. FIG. 39B shows the support surface assembly 22 in a compressed state corresponding to a reduced length of the support surface assembly 22 in which the separation distance between adjacent flat panel members is reduced. And FIG. 39C shows the support surface assembly 22 in an expanded state corresponding to a maximum length of the support surface assembly 22. By using a suitable number of flat panel members, the distance between adjacent flat panel members at locations between bonded areas can be kept below a distance suitable for ensuring that the support surface assembly 22 does not contract to a detrimental extent transverse to the expansion direction of the support surface assembly 22 when the support surface assembly 22 is expanded.

Any suitable material can be used to fabricate the support surface assembly 22. For example, the support surface assembly 22 can be made from polycarbonate strips, acrylic strips, and acrylic abrasion resistant strips. And any suitable method of manufacturing the support surface assembly 22 can be used. For example, separate strips can be joined via a suitable method (e.g., fusing, liquid welding, gluing). A form can be used to hold separate strips while they are joined. And the support surface assembly 22 can be fabricated by pouring a suitable material into a mold.

Any suitable fabrication method and material can be used to make the variable-planform shelving systems, tables, and clothes racks described herein. For example, suitable materials include steel, stainless steel, aluminum, galvanized steel, zinc, iron, titanium, and plastics (e.g., polycarbonate, acrylic, ABS, and HDPE). Suitable fabrication methods include, for example, stamping, water jetting, pouring, forming, metal casting, CNC machining, casting, and injection molding.

Figure 40:
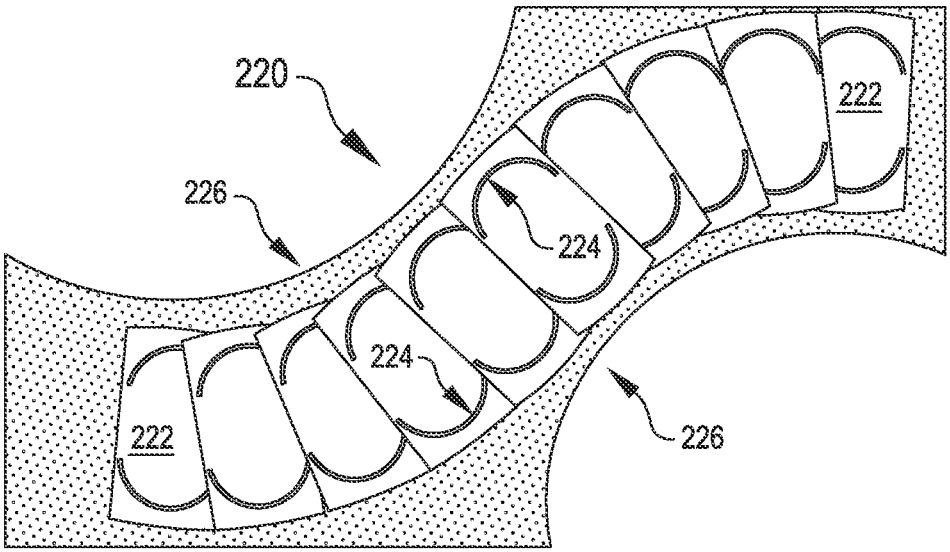
FIG. 40 is a plan view of a support surface assembly that includes overlapping coupled panels, in accordance with many embodiments.
Figure 41:
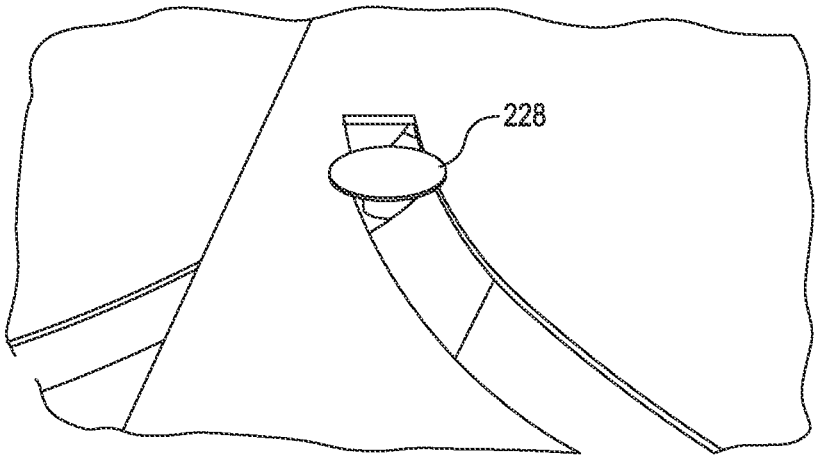
FIG. 41 is a close-up perspective view of a coupling feature that interfaces with slots in adjacent panels of the support surface assembly of FIG. 40.

FIG. 40 shows a support surface assembly 220 that can be used in place of the support surface assembly 22. The support surface assembly 220 includes a plurality of slotted panels 222 having slots 224. Each of the slotted panels has a substantially rectangular planform with slightly curved outer edges 226 so as to present a smooth combined edge when the support surface assembly 220 is shaped to have a curved planform such as shown in FIG. 40. Each of the slots 224 is shaped to overlap an adjacent slot 224 of an adjacent panel in each of the various planform configurations of the support surface assembly 220. At each of the overlapping locations of the slots 224, a coupling element 230 as shown in FIG. 41 is used to constrain the adjacent panels relative to each other. As the support surface assembly 220 is reshaped into different planform shapes, the coupling element 230 slides within the slots 224 as dictated by the changing position of the overlapped location between the slots 224. Suitable panels of the slotted panels 222 can be tied to underlying frames of the variable support platform or to the base support platform with intermediate panels being free to adopt positions to provide a smooth transition between panels that are tied to the underlying frames. For example, one end panel of the support surface assembly 220 can be tied to the first frame 30 of the variable support platform 28, the opposite end panel of the support surface assembly 220 can be tied to the second frame 32 of the variable support platform 28, and the center panel of the support surface assembly 220 can be tied to the third frame 34 of the variable support platform 28, thereby leaving all the remaining untied panels to reposition to suitable locations consistent with the geometry of the slots 224 such that the support surface assembly 220 has a planform with smoothly curved edges.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A shelving system having a variable planform, the shelving system comprising variable planform shelves, each variable planform shelf having a variable planform and each variable planform shelf comprising:

(a) a first frame providing a first part of a variable support platform;

(b) a second frame providing a second part of the variable support platform, relative positioning of the first and second frames being variable so as to vary the planform of the variable support platform;

(c) a third frame providing a third part of the variable support platform, the third frame being disposed between the first and second frames, relative positioning between the third frame and each of the first and second frames being variable to vary the planform of the variable support platform, wherein the third frame is slidingly coupled with each of the first and second frames, wherein relative orientation of the first and third frames is variable to vary the shape of the planform of the variable support platform, wherein relative orientation of the second and third frames is variable to vary the shape of the planform of the variable support platform, wherein each of the first and second frames has a slot that receives a portion of the third frame; and (d) a support surface assembly that is supported by the variable support platform and provides a support surface for items supported by the shelf, the support surface assembly being at least one of flexible or comprised of a plurality of linked panels so that the support surface provided is capable of varying in response to variation in the planform of the variable support platform, wherein each of the first, second, and third frames has an upper surface that interfaces with the support surface assembly; the upper surfaces of the first, second, and third frames being coplanar;

wherein the shelving system further comprises:

(A) a first variable planform shelf;

(B) a second variable planform shelf, the second variable planform shelf being elevated above the first variable planform shelf;

(C) at least one first support column supporting the first frames of the first and second variable planform shelves; and (D) at least one second support column supporting the second frames of the first and second variable planform shelves;

(E) a base including:

(i) an upper portion including a variable planform shelf;

(ii) a lower portion including a variable planform shelf;

(iii) at least one first column member attached to each of the first frames of the upper and lower portions;

(iv) at least one second column member attached to each of the second frames of the upper and lower portions; and (v) a plurality of third column members, each of the column members being attached to the third frames of the upper and lower portions; and (F) a kick plate assembly attached to the base, the kick plate assembly including:

(i) a first kick plate member attached to at least one of the first frames of the upper and lower portions;

(ii) a second kick plate member attached to at least one of the second frames of the upper and lower portions; and (iii) a third kick plate member attached to at least one of the third frames of the upper and lower portions; at least one of the first, second, or third kick plate members including an extension panel overlapping an adjacent one of the first, second, or third kick plate members for a plurality of planform configurations of the base.

2. A shelving system having a variable planform, the shelving system comprising variable planform shelves, each variable planform shelf having a variable planform and each variable planform shelf comprising:

(a) a first frame providing a first part of a variable support platform;

(b) a second frame providing a second part of the variable support platform, relative positioning of the first and second frames being variable so as to vary the planform of the variable support platform;

(c) a third frame providing a third part of the variable support platform, the third frame being disposed between the first and second frames, relative positioning between the third frame and each of the first and second frames being variable to vary the planform of the variable support platform, wherein the third frame is slidingly coupled with each of the first and second frames, wherein relative orientation of the first and third frames is variable to vary the shape of the planform of the variable support platform, wherein relative orientation of the second and third frames is variable to vary the shape of the planform of the variable support platform, wherein each of the first and second frames has a slot that receives a portion of the third frame; and (d) a support surface assembly that is supported by the variable support platform and provides a support surface for items supported by the shelf, the support surface assembly being at least one of flexible or comprised of a plurality of linked panels so that the support surface provided is capable of varying in response to variation in the planform of the variable support platform, wherein each of the first, second, and third frames has an upper surface that interfaces with the support surface assembly; the upper surfaces of the first, second, and third frames being coplanar;

wherein the shelving system further comprises:

(A) a first variable planform shelf;

(B) a second variable planform shelf, the second variable planform shelf being elevated above the first variable planform shelf;

(C) at least one first support column supporting the first frames of the first and second variable planform shelves; and (D) at least one second support column supporting the second frames of the first and second variable planform shelves; and (E) at least one price display assembly attached to at least one of the first and second shelves, the price display assembly including:

(i) a first price display segment attached to the first frame and configured to display a price tag;

(ii) a second price display segment attached to the second frame and configured to display a price tag; and (iii) a third price display segment slidably coupled with at least one of the first and second price display segments, the third price display segment being flexible and configured to display a price tag.

* * * * *